US005565742A

United States Patent [19]

Shichao et al.

[11] Patent Number: 5,565,742

[45] **Date of Patent: * Oct. 15, 1996**

[54] ELECTRONIC FLUORESCENT DISPLAY

[75] Inventors: Ge Shichao, Santa Clara; Victor Lam, Saratoga; Jemm Y. Liang, San Jose, all of Calif.

[73] Assignee: PanoCorp Display Systems, Sunnyvale, Calif.

[ * ] Notice: The portion of the term of this patent subsequent to Jul. 15, 2011, has been disclaimed.

[21] Appl. No.: 70,343

[22] PCT Filed: Jul. 14, 1992

[86] PCT No.: PCT/US92/05883

§ 371 Date: Jul. 2, 1993

§ 102(e) Date: Jul. 2, 1993

[87] PCT Pub. No.: WO93/02442

PCT Pub. Date: Feb. 4, 1993

Related U.S. Application Data

[63] Continuation-in-part of Ser. No. 730,110, Jul. 15, 1991, Pat. No. 5,229,691, and Ser. No. 657,867, Feb. 25, 1991, Pat. No. 5,170,100.

[51] Int. Cl.[6] ..... G09G 1/04; H01J 1/88; H01J 29/70

[52] U.S. Cl. ..... 315/366; 313/257; 313/422

[58] Field of Search ..... 313/257, 249, 313/250, 252, 265, 417, 422, 474; 315/366

[56] References Cited

U.S. PATENT DOCUMENTS

| | | | |
|---|---|---|---|
| Re. 31,558 | 4/1984 | Sinclair et al. | 313/422 |
| 2,500,929 | 3/1950 | Chilowsky | 315/366 |
| 3,935,499 | 1/1976 | Oess | 313/422 |
| 3,935,500 | 1/1976 | Oess et al. | 313/422 |
| 4,322,656 | 3/1982 | Huber et al. | 313/485 |
| 4,377,769 | 3/1983 | Beatty et al. | 313/495 |
| 4,651,049 | 3/1987 | Saeki et al. | 313/422 |
| 4,707,638 | 11/1987 | Hara et al. | 315/366 |
| 4,719,388 | 1/1988 | Oess | 313/422 |
| 4,737,683 | 4/1988 | Shichao et al. | 313/495 |
| 4,743,798 | 5/1988 | Washington | 313/422 |
| 4,812,716 | 3/1989 | Miyama et al. | 315/366 |
| 4,881,017 | 11/1989 | Tsuruoka | 313/422 |
| 4,887,000 | 12/1989 | Yamazaki et al. | 313/422 |
| 4,973,888 | 11/1990 | Morimoto et al. | 315/366 |
| 5,063,327 | 11/1991 | Brodie et al. | 313/482 |
| 5,083,058 | 1/1992 | Nonomura et al. | 313/422 |
| 5,113,274 | 5/1982 | Takahashi et al. | 359/66 |
| 5,229,691 | 7/1993 | Shichao et al. | 315/366 |

FOREIGN PATENT DOCUMENTS 0261896 9/1987 European Pat. Off. .

*Primary Examiner*—Gregory C. Issing
*Attorney, Agent, or Firm*—Majestic, Parsons, Siebert & Hsue

[57] ABSTRACT

In a cathodoluminescent display device, spacer elements are used to provide rigid mechanical support between the face and back plates when the chamber of the device is evacuated so that thin face and back plates may be used even for large-screen displays. The spacer support includes a spacer plate having holes therein for passage of electrons between the anode and cathode where a predetermined small number of one or more pixel dots corresponds to and spatially overlaps one hole, thereby reducing crosstalk. Shadow-reducing electrodes are employed on the back plate and spacer members alongside the cathode to cause the path of electrons from the cathode to the anode to spread out in order to reduce shadows caused by the presence of the spacer members. Various configurations of the two or three sets of grid electrodes may be employed to improve resolution and focusing. A linear array of cathode filament segments is used instead of one long integral cathode wire where the ends of the segments overlap to eliminate any visible gaps caused by the end portions of the segments being at lower temperatures than intermediate portions.

61 Claims, 20 Drawing Sheets

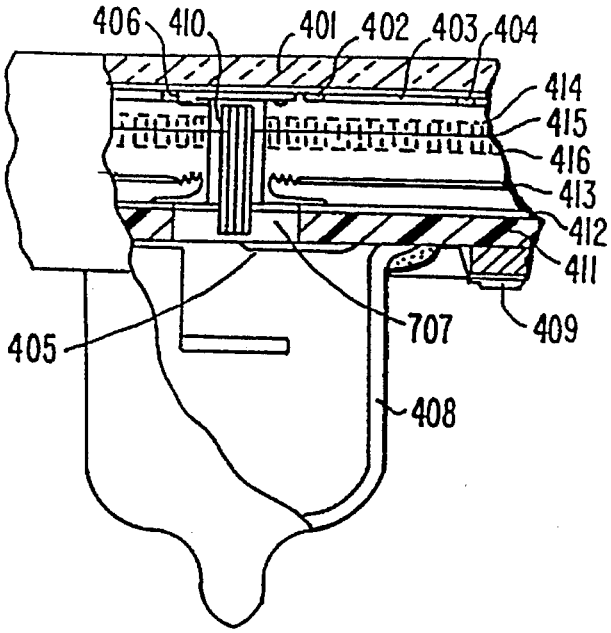
FIG. 23A.
PRIOR ART
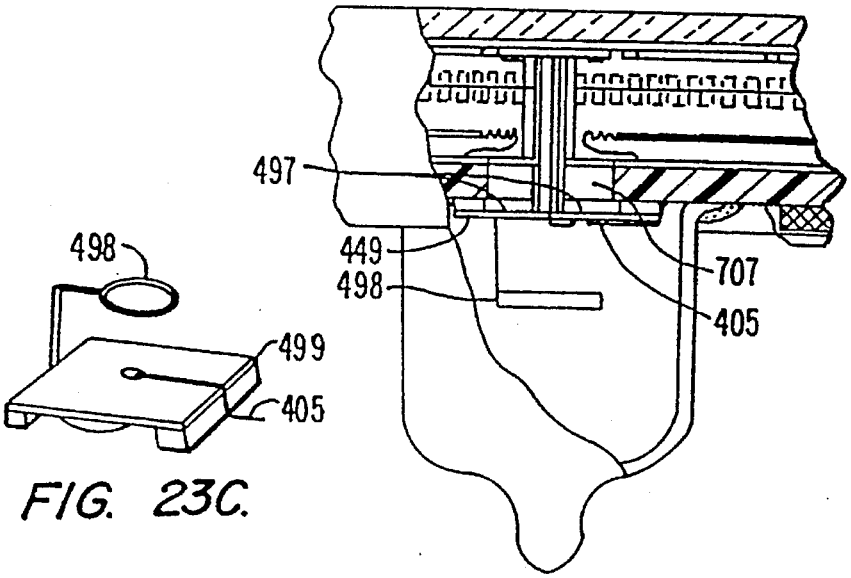
FIG. 23C.
FIG. 23B.

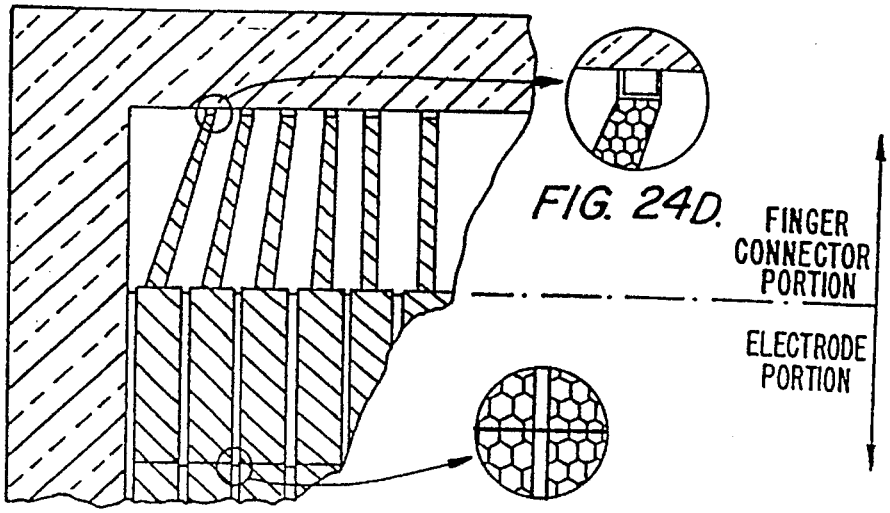
FIG. 24A.
FIG. 24D.
FIG. 24E.
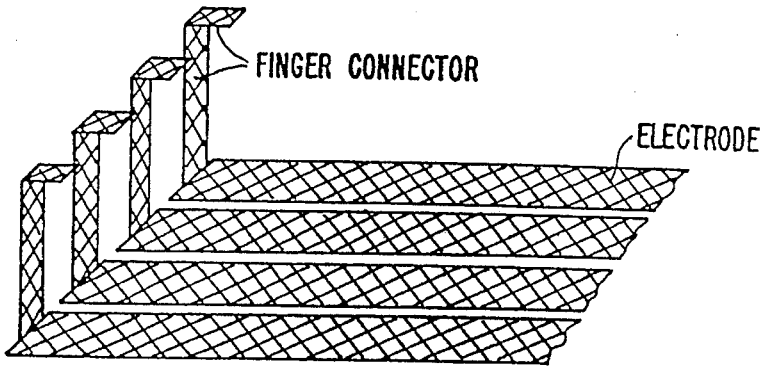
FIG. 24B.
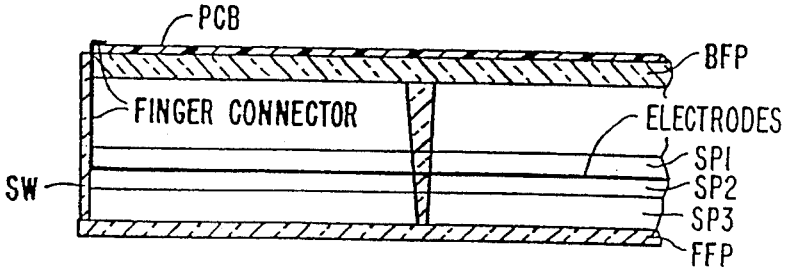
FIG. 24C.

ELECTRONIC FLUORESCENT DISPLAY

This application is a national application of PCT application PCT/US92/05883, filed Jul. 14, 1992, which is a continuation-in-part application Ser. No. 730,110, filed Jul. 15, 1991, now U.S. Pat. No. 5,229,691, and of Ser. No. 657,867 filed Feb. 25, 1991, now U.S. Pat. No. 5,170,100, hereinafter referred to as the "parent applications." Ser. No. 657,867 is incorporated herein by reference in its entirety.

BACKGROUND OF THE INVENTION

This invention relates in general to electronic fluorescent display devices and in particular, to an improved low voltage cathodoluminescent device particularly useful for full color hang-on-wall type displays.

Researchers in many flat panel display technologies, such as LCD, PDP, EL, LED, VFD, flat CRT, have been trying to develop a full-color hang-on-wall television. Color televisions of several inch to ten inch screens using LCD technology have been produced. Such televisions using LCD employ a large number of thin film transistors on their basic boards and are expensive. Because of difficulty of manufacture, it is difficult to further increase the size of the basic board and of the television screen of such products. LCD televisions employ a back illumination scheme. The basic board with thin film transistors transmits a low proportion of light from a light source and this limits the brightness of the display. Because of these difficulties, in order to develop larger color televisions using LCD technology, research in this area is primarily focused on projection televisions.

Color televisions using PDP technology is still in the research stage and at this point, color televisions of twenty inch screen have been proposed. The main problems in the development of PDP type color televisions include its low efficiency in phosphorescence, its complicated drive circuitry, unevenness in brightness and short product life. Research in LED, EL still has not been able to develop luminescent elements for blue lights. While multi-color displays have been developed using VFD, such devices are limited to smaller television screens. Furthermore, aside from the use of luminescent elements using zinc oxide and zinc for generating blue-green light, the brightness, efficiency and product life of other color phosphors are still not satisfactory. From the above, it will be evident that large-screen flat full-color hang-on-wall televisions that have been proposed using any of the existing flat panel display technologies are not entirely satisfactory.

Cathode ray tubes (CRT) have been used for display purposes in general, such as in conventional television systems. The conventional CRT systems are bulky primarily because depth is necessary for an electron gun and an electron deflection system. In many applications, it is preferable to use flat display systems in which the bulk of the display is reduced. In U.S. Pat. No. 3,935,500 to Oess et al., for example, a flat CRT system is proposed where a deflection control structure is employed between a number of cathodes and anodes. The structure has a number of holes through which electron beams may pass with sets of X-Y deflection electrodes associated with each hole. The deflection control structure defined by Oess et al. is commonly known as a mesh-type structure. While the mesh-type structure is easy to manufacture, such structures are expensive to make, particularly in the case of large structures.

Another conventional flat panel system currently used is known as the Jumbotron such as that described in Japanese Patent Publication Nos. 62-150638 and 62-52846. The structure of Jumbotron is somewhat similar to the flat matrix CRT described above. Each anode in the Jumbotron includes less than 20 pixels so that it is difficult to construct a high phosphor dot density type display system using the Jumbotron structure.

Both the flat matrix CRT and Jumbotron structures are somewhat similar in principle to the flat CRT system described by Oess et al. discussed above. These structures amount to no more than enclosing a number of individually controlled electron guns within a panel, each gun equipped with its own grid electrodes for controlling the X-Y addressing and/or brightness of the display. In the above-described CRT devices, the control grid electrodes used are in the form of mesh structures. These mesh structures are typically constructed using photo-etching by etching holes in a conductive plate. The electron beams originating from the cathodes of the electron guns then pass through these holes in the mesh structure to reach a phosphor material at the anodes. As noted above, mesh structures are expensive to manufacture and it is difficult to construct large mesh structures. For this reason, each cathode has its own dedicated mesh structure for controlling the electron beam originating from the cathode. Since the electron beam must go through the hole in the mesh structure, a large number of electrons originating from the cathode will travel not through the hole, but lost to the solid part of the structure to become grid current so that only a small portion of the electrons will be able to escape through the hole and reach the phosphor material at the anode. For this reason the osmotic coefficient, defined as the ratio of the area of the hole to the area of the mesh structure of the cathode, of the above-described devices is quite low.

As taught in the parent application, to avoid the problem of low osmotic coefficient in conventional devices, instead of using individually controlled electron guns, two or more sets of elongated grid electrodes may be employed for scanning and controlling the brightness of pixels at the entire anode where the area of the grid electrodes that blocks electrons is much smaller than the area of the mesh structure of the conventional devices.

The above-described CRT devices have another drawback. In the case of the Jumbotron, each electron gun is used for scanning a total of 20 pixels. In the Oess et al. patent referenced above, each electron beam passing through a hole is also used for addressing and illuminating a large number of pixels. When illumination at a particular pixel is desired, certain voltages are applied to the X-Y deflection electrodes on the inside surface of the hole, causing electrons in the electron beam passing through the hole to impinge the anode at such pixel. However, electrical noise and other environmental factors may cause the electron beam in the Oess et al. system and the Jumbotron to deviate from its intended path. Furthermore, certain electrons will inevitably stray from the electron beam and land in areas of the anode which is different from the pixel that is addressed. This causes pixels adjacent to the pixel which is addressed to become luminescent, causing crosstalk and degrades the performance of the display.

As is known to those skilled in the art, the inner chamber of a cathodoluminescent visual display device must be evacuated so that the electrons emitted by the cathode would not be hindered by air particles and are free to reach phosphor elements at the anode. For this reason, the housing for housing the cathode, anode and control electrodes must be strong enough to withstand atmospheric pressure when the chamber within the housing is evacuated. When the display device has a large surface area, as in large screen displays, the force exerted by the atmosphere on the housing can be substantial when the chamber within the housing is evacuated. For this reason, conventional cathodoluminescent display devices have employed thick face and back plates to make a sturdy housing. Such thick plates cause the housing to be heavy and thick so that the device is heavy, and expensive and difficult to manufacture. It is therefore desirable to provide an improved cathodoluminescent visual display device where the above-described difficulties are not present.

SUMMARY OF THE INVENTION

This invention is based on the observation that, to reduce crosstalk between adjacent pixels or pixel dots, a spacer plate is employed with holes therein for passage of electrons between the anode and cathode, where a predetermined number of one or more pixel dots correspond to and spatially overlap one hole, thereby reducing crosstalk. In the preferred embodiment, a small number of pixel dots, such as two, four or six pixel dots, correspond to and spatially overlap one hole.

One aspect of the invention is directed towards a cathodoluminescent visual display device having a plurality of pixel dots for displaying images when the device is viewed in a viewing direction. The device comprises a housing defining a chamber therein, the housing having a face plate and a back plate, and a side wall or plate between the face and back plates surrounding and enclosing the chamber. The device also includes an anode on or near the face plate, luminescent means that emits light in response to electrons, and that is on or adjacent to the anode; at least one cathode in the chamber between the face and back plates; and at least a first and a second set of elongated grid electrodes between the anode and cathode. The electrodes in each set overlap the luminescent means, cathode and electrodes in at least one other set at points when viewed in the viewing direction, wherein the overlapping points define pixel dots. The device further includes means for heating the cathode, causing the cathode to emit electrons, means for applying electrical potentials to the anode, cathode and the two or more sets of grid electrodes, causing the electrons emitted by the cathode to travel to the luminescent means at the pixel dots on or adjacent to the anode for displaying images. The device also includes spacer means connecting the face and back plates to provide mechanical support for the plates so that the housing would not collapse when the housing is evacuated. The spacer means includes a spacer plate defining holes therein for passage of electrons between the anode and cathode. A predetermined number of one or more pixel dots correspond to and spatially overlap one hole. The spacer plate reduces crosstalk. The spacer plate is attached to the side wall at locations surrounding the chamber to strengthen the housing against lateral forces.

In the preferred embodiment of the invention, the spacer means also includes at least one net-shaped structure defining meshes that each permits electron passage to address a plurality of pixel dots. The structure and the spacer plate rigidly connect the face and back plates. In the preferred embodiment, the spacer means also includes elongated spacer members adjacent to the cathode. Portions of the spacer plate, the structure and the spacer members abut each other and the face and back plates along a line normal to the face and back plates forming a rigid support for the face and back plates along the line. Also in the preferred embodiment, the holes and the spacer plate are tapered and may include separation walls to separate each hole into smaller holes that match individual pixel dots to further reduce crosstalk between adjacent pixel dots.

For large displays, it is desirable for the cathode to be broken up into shorter filaments to reduce the amount of sagging and for easier handling. One common problem in cathodoluminescent visual display systems is that the two ends of the filament in a cathode are colder than the intermediate portion and, for that reason, emits fewer electrons compared to the intermediate portion. When a long cathode is broken up into shorter filament segments, the above problem of inefficient electron emission at the ends of the filament is compounded. This invention is also based on the observation that, by arranging the filaments so that an end portion of each filament segment is approximate to and overlaps an end portion of a different filament segment when viewed in the viewing direction, the above-described problem is alleviated. Therefore, another aspect of the invention is directed towards a cathodoluminescent visual display device which includes an anode, a luminescent means that emits light in response to electrons, and that is on or adjacent to the anode and at least one cathode. The device includes also at least a first and a second set of elongated grid electrodes between the anode and cathode for scanning and controlling the brightness of the device and means for applying electrical potentials to the anode, the at least one cathode and the sets of grid electrodes, means for heating the cathode causing the cathode to emit electrons and a housing for holding the anode, cathode, grid electrodes and luminescent means. The electrons emitted by the cathode travel to the luminescent means at the pixel dots on or adjacent to the anode for displaying images. The cathode includes at least two elongated filaments, each having two ends, and means connecting the filaments to the housing. The electrons emitted by one filament travel to the luminescent means at pixel dots that are substantially non-overlapping with the pixel dots reached by the electrons emitted by the other filament when viewed in the viewing direction. The two filaments are arranged with an end portion of one filament being proximate to and overlapping an end portion of the other filament when viewed in the viewing direction so as to reduce the adverse effects caused by such end portions being at a lower temperature compared to the remaining portions of the filament.

Another aspect of the invention is directed towards the use of at least two sets of elongated grid electrodes for scanning and for controlling the brightness of the pixel dots. The device according to this aspect includes an anode, luminescent means, a cathode, means for heating the cathode, at least a first and a second set of elongated grid electrodes all essentially as described above, and means for applying electrical potentials to the anode, cathode and the grid electrodes, causing electrons emitted by the cathode to travel to the luminescent means at the pixel dots on or adjacent to the anode for displaying images. The potentials applied are so that the first set of grid electrodes is used for scanning and the second set of electrodes is used for controlling the brightness of the pixel dots.

Yet another aspect of the invention is directed towards reducing any shadows caused by spacer members used to support the face and back plates. Such device includes a housing defining a chamber therein, said housing having a face plate and a back plate, said device further including an anode on or near the face plate and luminescent means that emits light in response to electrons, and that is on or adjacent to the anode. The device includes at least one elongated cathode in the chamber between the face and the back plates, at least a first and a second set of elongated grid electrodes between the anode and cathode and means for heating the cathode causing the cathode to emit electrons in a electron cloud. The grid electrodes in each set overlaps the luminescent means, cathode and electrodes in at least one other set at points when the device is viewed in a viewing direction, wherein the overlapping points define pixel dots. The device includes also means for applying electrical potentials to the anode, cathode and the two or more sets of grid electrodes and spacer means connecting the face and back plates to provide mechanical support for the plates so that the housing would not collapse when the chamber is evacuated. The electrons emitted by the cathode travel to the luminescent means at the pixel dots on or adjacent to the cathode for displaying images. The spacer means includes elongated spacer members alongside and not overlapping the cathode when viewed in the viewing direction. The members are located between the back plate and the grid electrodes, between the sets of grid electrodes or between the grid electrodes and the anode. The device further includes a first set of one or more elongated shadow reducing electrodes adjacent to the spacer members. The potential applying means applies to the shadow reducing electrodes, a potential that is higher than that applied to the cathode by the potentials applying means, causing electrons in the electron cloud emitted by the cathode to spread before traveling towards the anode to thereby reduce any shadows caused by the spacer members.

Another aspect of the invention is directed towards a cathodoluminescent visual display apparatus comprising a mosaic of devices arranged side by side to form a larger display. Each of the devices includes the components of the device described above, where each device includes a spacer means, said spacer means including a spacer plate defining holes therein for passage of electrons between the anode and cathode, wherein a predetermined number of one or more pixel dots correspond to and spatially overlap one hole when viewed in the viewing direction, thereby reducing crosstalk.

This invention enables full-color hang-on-wall televisions with screen size from several inch to one hundred inch to be manufactured. Such televisions generate a full range of colors of high resolution and brightness and have housings that are relatively thin even with large screen size televisions. The spacer means used for supporting the face and back plates enable the thin display housings to have sufficient mechanical strength even in large screen displays. The display has reduced crosstalk and shadow reducing electrodes enable the display to have even brightness despite the use of spacers. The arrangement of grid electrodes also enable the display to have improved focusing and resolution.

In addition to the above aspects of the invention, the inventors have discovered a number of improvements in the general context of the invention described above. These improvements are summarized below.

The cathode may include two or more elongated filaments having two ends and spring means connecting the two ends of the filament to the housing. For at least one filament, there is another filament located adjacent to the spring means for supporting said at least one filament to reduce any dark areas caused by the spring means.

The luminescence means that emits light in response to electrons may include a phosphor layer and a protective layer of magnesium oxide or zinc oxide to increase the useful life of the phosphor layer.

In another discovery, the housing of the display device includes a housing including a front face plate, a back face plate, and a side wall between the front and back plates surrounding and enclosing a chamber. The spacer plate layers or spacer bar arrays, the front face plate, and the back face plate define alignment holes therein. The device includes alignment pins placed in the holes to fix the relative positions between the plates and/or arrays.

In another improvement, the grid electrodes comprise groups of parallel fine metal wires, metal wire cloth meshes, perforated or etched metal foils, or plated electrodes on the surfaces of the spacer plates or spacer bar arrays.

Another improvement is directed to a method for displaying an image using the device the various aspects of which are described above where the device includes a first and a second set of grid electrodes in different planes between the anode and cathode. First, the cathode is caused to generate an electron cloud. The method includes the step of selecting from the grid electrodes, selected ones to be scanned. Electrical potentials higher than those applied to the cathode are applied sequentially to the selected ones of the grid electrodes at a time for scanning. The electrical potentials applied to the non-selected grid electrodes are, at least at one time, lower than those applied to the cathode to restrict a spatial spread of the passage of electrons from the cathode to the anode, thereby improving scanning resolution and reducing crosstalk.

In another improvement, the side wall, the spacer bars, spacer plates, and the back face plates have electrodes thereon in or facing the chamber. The electrodes contain material that emit secondary electrons upon being impinged by electrons, thereby spreading out the electrons generated by the cathode to improve the uniformity of the device and countering the electric field caused by setting charge buildup.

In yet another improvement, areas of the phosphor dots that emit light upon impingement of electrons define the active areas of the dots, and the active areas of at least some dots are different from those of other dots. This improves uniformity of images displayed or equalize the lifetime of phosphor dots for emitting light of different colors. Such objective can be achieved by yet another method improvement where electrical potentials are applied so that some grid electrodes are scanned for a longer time period or such that higher electrical potentials are applied to some grid electrodes than other grid electrodes when such other grid electrodes are scanned.

Another improvement improves the contrast and image of the display. In such improvement, the phosphor dots are arranged in linear arrays of the same color selected from the group: red, green and blue. In the preferred embodiment, the pixel dots form a repeating RGBG dot array, in the vertical and the horizontal direction, so that every green phosphor dot is adjacent to a red and blue phosphor dot in both the vertical and horizontal directions.

The front face plate is made of, or includes, a layer of, spectrum selected glass with transmittance peaks that match the emission peaks of the phosphor dots to improve the contrast and image quality.

In another improvement, the front face plate comprises a Fresnel optical lens.

Another aspect of the invention is directed towards a method for assembling a cathodoluminescent visual display device. The method comprises providing a front face plate and a back face plate, one or more side walls, a plurality of electrodes including at least one cathode, an anode and grid electrodes, and the step of etching holes in one or more photosensitive plates to provide one or more spacer plates or net-shaped spacer structures for passage of electrons. The method further comprises placing the spacer plate or structures and the electrodes between the front face and back face plates, and attaching the face plates, side walls, and spacer plates or structures, to form the device. In the method, preferably, the face plates, side walls and spacer plates and structures have alignment holes, and alignment pins are used to align the different components with respect to one another. Preferably, the components are aligned after the placing step above and before the attaching step.

BRIEF DESCRIPTION OF THE DRAWINGS

FIG. 19C shows the preferred phosphor dot arrangements.

FIG. 23A shows a conventional design for outgassing and anode connection.

FIGS. 23B, 23C show the design of this invention for outgassing and anode connection.

FIGS. 24A–24E shows a preferred embodiment of electrodes and finger connectors of the display device of this invention.

FIG. 25A is a cut away view from perspective 25A—25A of FIG. 25B.

FIG. 25A is a cut away view from perspective 25A—25A of FIG. 25B.

FIG. 25B is a view from the back face plate side.

FIG. 25C is a cut away view from perspective 25C—25C of FIG. 25B.

DETAILED DESCRIPTION OF THE PREFERRED EMBODIMENT

Figure 1B:
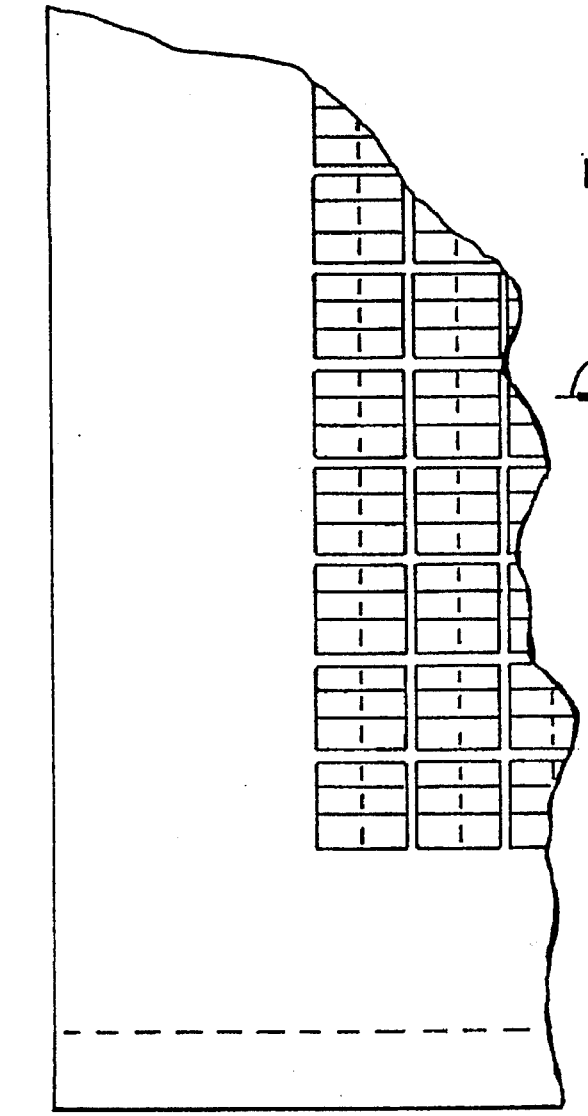
FIG. 1B is a front view of the device of FIG. 1A but where the current source of FIG. 1A is not shown.
Figure 1A:
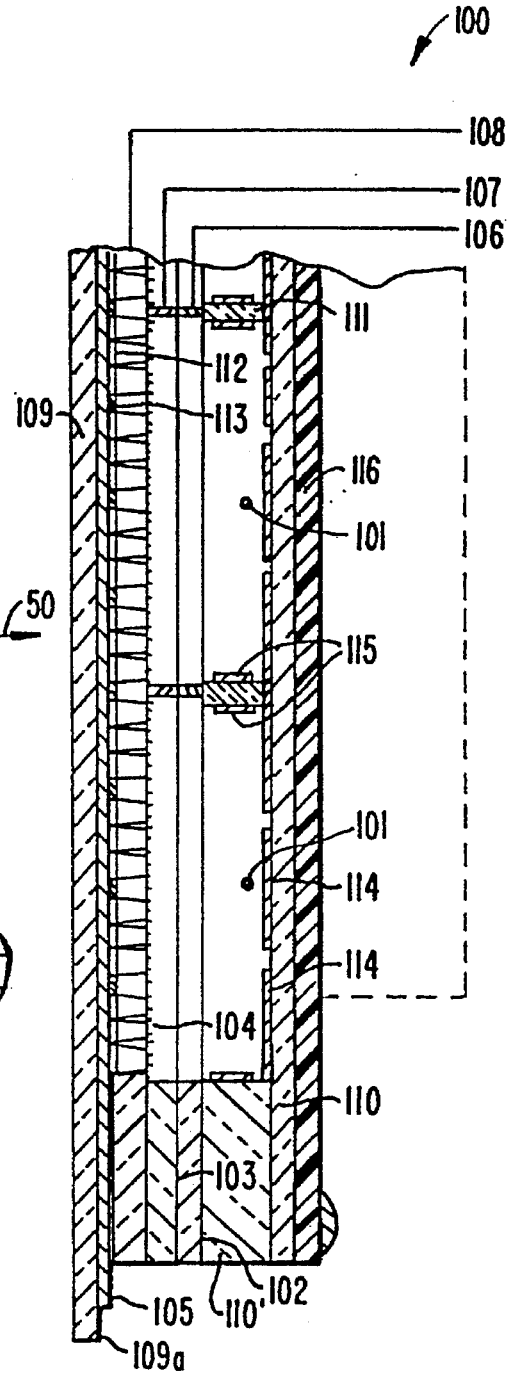
FIG. 1A is a cross-sectional view of a portion of a cathodoluminescent visual display device to illustrate the preferred embodiment of the invention.

FIG. 1A is a cross-sectional view of a portion of a flat panel cathodoluminescent visual display device 100 and of a current source 150 for supplying power to device 100 to illustrate the preferred embodiment of the invention. FIG. 1B is a front view of device 100 of FIG. 1A along a viewing direction 50 of FIG. 1A. Since the appearance of the device and of all devices described herein is the determinating factor in many instances, the "viewing direction" hereinafter will refer to a direction viewing the display device from the front of the device as in FIGS. 1A and 1B as is normally the case when a viewer is observing a display, eventhough such direction is not shown in many other figures. In this context, if two components of the device overlap or non-overlap when viewed in such viewing direction, such components are referred to below as "overlapping" or "non-overlapping." Device 100 includes cathodes 101, three sets of grid electrodes 102, 103, 104 anode 105 and spacers 106, 107 and 108. These electrodes and parts are sealed in a chamber enclosed by face plate 109 and back plate 110 and side plate or wall 110' where the face, back and side plates are attached to form a portion of a housing for a flat vacuum device, surrounding and enclosing a chamber. The chamber of device 100 enclosed by the face, side and back plates is evacuated so that the electrons generated at the cathodes travel freely towards the anode in a manner described below.

Cathodes 101 form a group of substantially parallel direct heated oxide coated filaments. Each of the three sets of grid electrodes 102, 103 and 104 comprises substantially parallel thin metal wires. In the preferred embodiment in FIG. 1A, between the first set of grid electrodes 102 referred to below as G1 and back plate 110 is a group of substantially parallel elongated spacer members 111 placed alongside filaments 101 and are preferably parallel to the filaments 101. Metal wires G1 are attached to spacers 101 to reduce the amplitude of their vibrations caused by any movements of the device. Between the first set of grid electrodes 102 (G1) and the second set of electrodes 103 (G2) is a spacer structure 106 which is net-shaped, the structure defining meshes therein, each permitting electron passage between the cathode and the anode to address a plurality of pixel dots. Between the second set of grid electrodes 102 (G2) and a third set of grid electrodes 103 (G3) is another spacer structure 107 preferably similar in structure to structure 106. These two spacer structures separate the three sets of grid electrodes. The wires of the three sets of grid electrodes may be attached to these two spacer structures as well to reduce vibrations.

On the inside surface 109*a* of face plate 109 is anode 105 comprising a layer of transparent conductive film having three primary color low voltage cathodoluminescent phosphor dots 112, and black insulation layer 113 between the phosphor dots io enhance contrast. Between anode 105 and the third set of electrodes 104 (G3) is a spacer plate 108 having holes therein, where the holes overlap and match the phosphor dots and anode. This means that each hole in spacer plate 108 corresponds to a small number of a predetermined group of pixel dots forming a pixel, and has substantially the same size and shape as the pixel and is located in plate 108 such that its location matches that of its corresponding pixel, so that electrons from the cathode may reach any part of the corresponding phosphor dots in the pixel through such hole and not the insulating layer 113 surrounding such pixel. The wires of electrodes G3 are attached to and placed between spacer plate 108 and spacer structure 107.

As described in more detail below, the inside surface of back plate 110 and the surfaces of elongated spacer members 106 have shadow reducing electrodes 114, 115 respectively for improving brightness uniformity of the display. The outside surface of back plate 110 is attached to printed circuit board 116 to which are soldered input and output leads for the cathode, anode and the three sets of grid electrodes. Cathodes 101 are connected to a current source 150 (connections not shown in FIG. 1A) for heating the cathode filaments. Other than source 150, the drive electronics for device 100 has been omitted to simplify the diagram.

When source 150 supplies current to cathodes 101, the cathode filaments are heated to emit electrons in an electron cloud. This is very different from multiple CRT type devices, where electron beams are generated instead of electron clouds. These electrons in the electron cloud are attracted towards the anode to which a high positive voltage has been applied relative to the cathodes. The paths of electrodes when traveling towards the anode are modulated by voltages applied to the three sets of grid electrodes so that the electrons reach each phosphor dot at the appropriate pixels addressed or scanned for displaying color images.

Figure 2B:
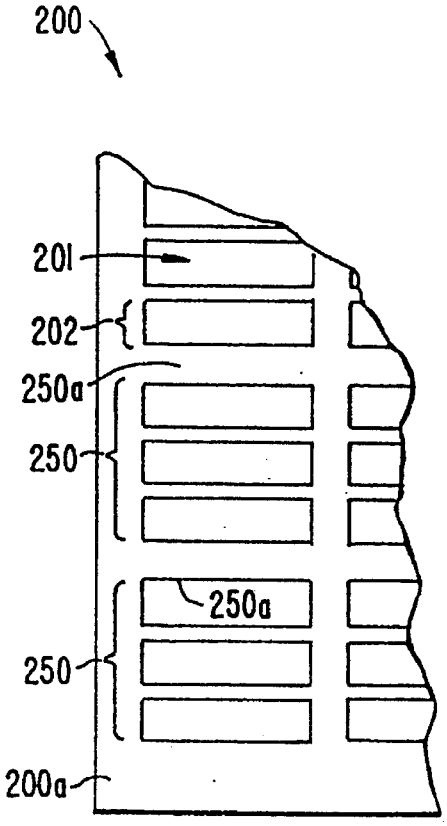
FIG. 2B is a front view of a portion of the spacer plate shown in FIG. 2A.
Figure 2A:
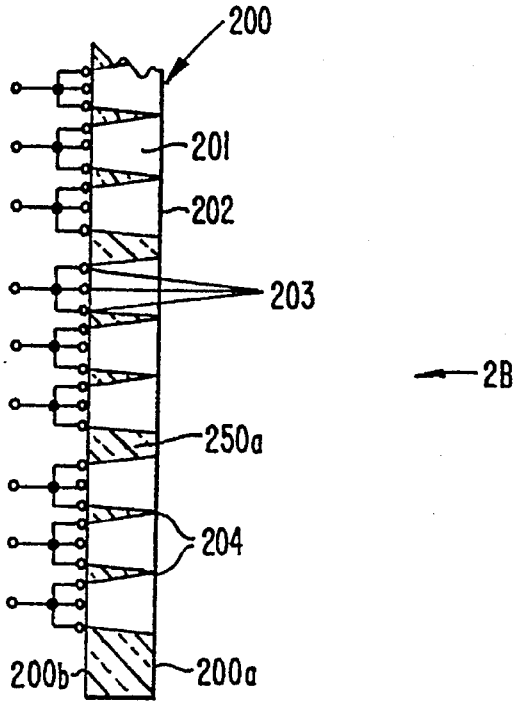
FIG. 2A is a cross-sectional view of a portion of a spacer plate in the device of FIG. 1A and of grid electrodes used for modulating the brightness of the display.

As discussed above, electrical noise and stray electrons in conventional CRT systems frequently cause pixels adjacent to the pixel addressed to become luminescent, resulting in crosstalk and degradation of the performance of the CRT device. Crosstalk is reduced by means of the spacer plate 108 which is shown in more detail in FIGS. 2A, 2B. FIG. 2A is a cross-sectional view of a spacer plate 200 and FIG. 2B is a front view of spacer plate 200 from direction 2B in FIG. 2A, where the electrodes of FIG. 2A have been omitted to simplify the figure in FIG. 2B. The spacer plate 200 is preferably made of a photosensitive glass-ceramic material; in the preferred embodiment plate 200 is made of a lithium silicate glass matrix with potassium and aluminum modifiers sensitized by the addition of trace amounts of silver and cerium. Holes 201 in plate 200 may be formed by photoetching. Holes 201 may have slanted surfaces so that their ends 202 at the front surface 200*a* are larger than the ends of the holes at the rear surface 200*b* of the plates. The ends 202 of the holes 201 at the front surface 200*a* are each substantially of the same size as its corresponding phosphor or pixel dots where the locations of the holes 201 are such that ends 202 match and overlap substantially its corresponding pixel dots. Holes 201 are substantially rectangular in shape, matching the shape of their corresponding pixel dots.

At the ends of holes 201 at rear surface 200*b* are a number of grid wires 203 (wires in the third set of electrodes 104 in FIG. 1A) substantially parallel to the long sides of holes 201. One or more wires 203 are aligned with each hole; if more than one wire overlaps a hole which is the case shown in FIG. 1A where three wires overlap one hole, the wires overlapping the same hole are electrically connected to form an electrode. Such electrodes formed by one or more grid wires may be used for controlling the brightness of the pixel dot corresponding to such hole by controlling the voltages of the electrode. As shown in FIG. 2B, each pixel 250 may correspond to three adjacent holes 201 corresponding to three phosphor pixel dots with one red, one blue and one green phosphor dot. The arrangement of holes 201 in plate 200 may be viewed as a big hole 250 corresponding to a single pixel of the display, where plate 200 has two separation walls 204 for each hole 250 dividing the hole into three smaller holes 201, each smaller hole matching, overlapping and corresponding to a red, blue or green phosphor dot of the pixel.

Separation walls 204 reduce or eliminate crosstalk between adjacent phosphor dots of the same pixel, so that color purity of the display is much improved. As shown in FIG. 2A, separation walls 204 are wedge-shaped, with the thin end of the wedge facing surface 200*a* to minimize any dark shadows cast by the separation walls on the image displayed. In reference to FIGS. 2A, 1A, electrons originating from cathodes 101 would enter holes 201 through the ends of the holes at the rear surface 200*b* of spacer plate 200 and emerge at ends 202 of the holes. Since ends 202 of the holes overlap and match their corresponding phosphor and pixel dots, the electrons impinge on such dots, causing the appropriate dot addressed to become luminescent for displaying images.

The entire spacer arrangement of the display device of FIG. 1A will now be described by reference to FIGS. 1A and 2A. In reference to FIG. 1A, spacer structures 106 and 107 each comprises a net-shaped structure which may simply be composed of a first array of substantially parallel bars rigidly connected to a second array of substantially parallel bars where the two sets of bars are substantially perpendicular to one another, defining meshes between any pair of adjacent bars in the first set and another pair of adjacent bars in the second set. Preferably, each mesh is large in area to encompass a number of pixels so that electrons passing between the cathodes and anode destined for such pixels will pass through such mesh, where the bars do not block a high percentage of the electrons generated.

The two spacer structures 106, 107 and spacer plate 108 (200 in FIG. 2A) are stacked in such a manner to provide a strong rigid support for the face and back plates 109, 110. As shown in FIG. 1A, wall 250*a* (not so labelled in FIG. 1A) of spacer plate 108 (same as plate 200 of FIG. 2A) is aligned with a bar in structure 107 and another bar in structure 106 as well as with spacer members 111 along a line which is substantially normal to face and back plates where the face and back plates are substantially parallel. In such manner, the aligned portions of spacer plate 108, structures 106, 107 and spacer member 111 abut one another and the face and back plates, forming a support for the face and back plates along a line normal to the face and back plates. Obviously, structures 106, 107, plate 108 and member 111 may include other portions which are not aligned along a line normal to the face and back plates and the face and back plates need not be parallel to each other; all the and may such configurations are within the scope of invention. With such rigid support for the face back plates, the area of the screen of display 100 be very large while the face and back plates may be made with relatively thin glass. Despite the relatively thin face and back plates, the spacer arrangement described above results in a mechanically strong housing structure adequate for supporting a large screen housing for the display when the housing is evacuated.

To minimize undesirable shadows in the display, rigid support is provided through portions of the spacer plate 108, structures 106, 107 and members 111 that correspond to portions of the screen between adjacent pixels. The thicknesses of wedges 204 at the front surface 200*a* of the spacer plate 200 (108) are smaller than or equal to the separation between adjacent pixel dots. To construct very large screen televisions, for ease of manufacture, spacer plate 108 and spacer structures 106, 107 may be constructed from smaller plates and structures in constructing a larger plate or structure using such smaller plates and structures by placing the smaller plates or structures in the same plane adjacent to one another in a two-dimensional array to form a larger plate or structure.

Figure 3C:
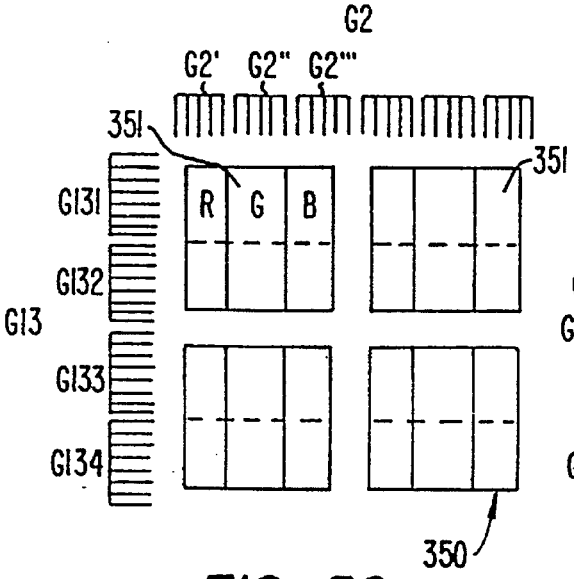
FIG. 3C is a schematic view of an arrangement of the pixel dots in a pixel.
Figure 3D:
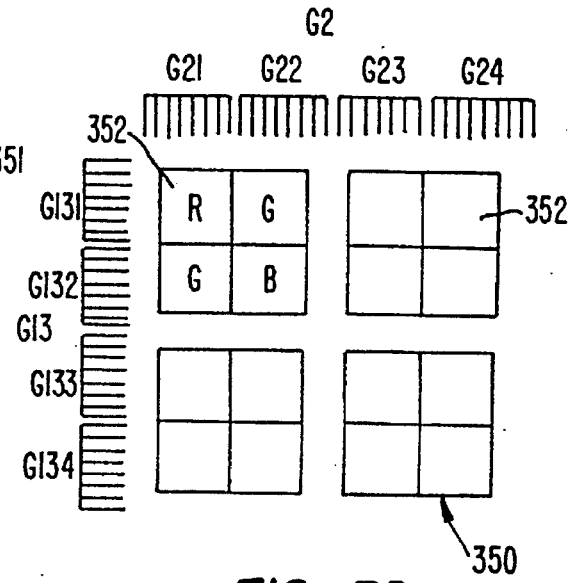
FIG. 3D is a schematic view of another arrangement of pixel dots within a pixel.
Figure 3B:
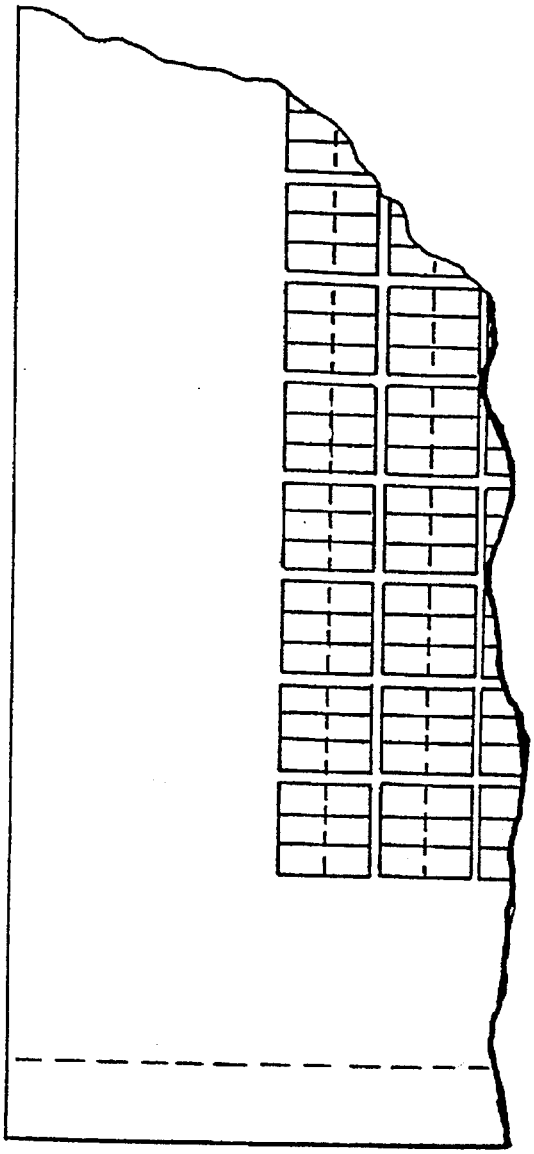
FIG. 3B is a front view of the portion of the device 300 in FIG. 3A.
Figure 3A:
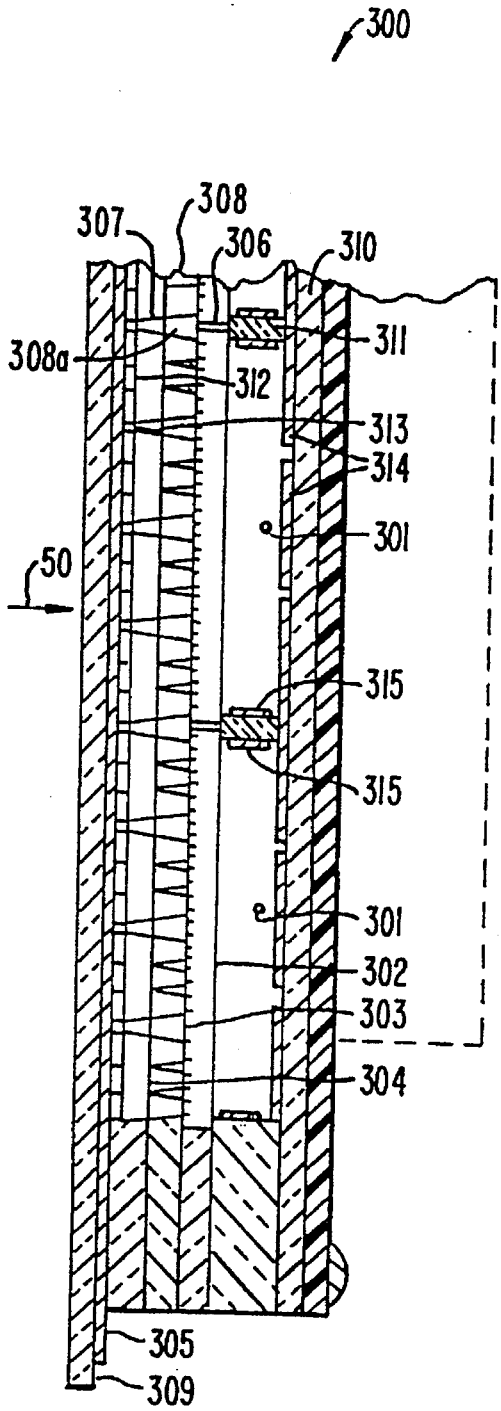
FIG. 3A is a cross-sectional view of a portion of the cathodoluminescent visual display device to illustrate an alternative embodiment of the invention.

FIG. 3A is a cross-sectional view of a portion of a cathodoluminescent visual display device 300 to illustrate an alternative embodiment of the invention. FIG. 3B is a top view of the portion of the device 300 in FIG. 3A. As shown in FIG. 3A, cathodes 301, three sets of grid electrodes 302, 303, 304, anode 305 are enclosed within a chamber between face plate 309 and back plate 310 as in FIG. 3A. Device 300 also includes a spacer plate 308 similar in structure to spacer plate 108 of FIG. 1A and spacer structures 306, 307 similar in structure to structures 106, 107 of FIG. 1A. Device 300' also includes spacer members 311 similar to members 111 of FIG. 1A, where the members 311 are placed alongside cathodes 301 and are connected to the spacer structures 306, 307 and spacer plate 308 in the same manner as in FIG. 1A for providing a rigid support to the face and back plates. Device 300 differs from device 100 of FIG. 1A in that the spacer plate 308 is placed between the second set of grid electrodes 303 (G2) and a third set of grid electrodes 304 (G3) instead of between the third set of grid electrodes and the anode as in device 100; instead, the spacer structure 307 is placed between the third set of grid electrodes and the anode. Thus if the first, second and third sets of grid electrodes are placed respectively in the first, second and third planes between the planes of the face plates 309 and the back plate 310, the spacer plates 108, 308 may be placed between either the plane of the anode and the third plane, or between the third and second planes. Preferably the face and back plates are substantially parallel to one another. Device 300 also differs from device 100 of FIG. 1A in that in device 300, the first and third sets of electrodes 302, 304 are substantially parallel to one another but are substantially perpendicular to electrodes in the second set 303 and to the cathodes 301. In device 100 in FIG. 1A, however, the first and second sets of grid electrodes 103, 102 are substantially parallel to one another but are substantially perpendicular to the third set of grid electrodes 104 and cathodes 101.

As shown in FIG. 3A, the spacer bars in structure 307 are preferably also tapered at substantially the same angle as the tapering dividing members between pixels in spacer plate 308 and are aligned therewith and are of such widths as shown in FIG. 3A so that these spacer bars and the walls 308*a* between the holes (similar to wall 250*a* of FIG. 2A) in the spacer plates 308 form an essentially smooth tapering surface to maximize the number of electrons that can be transmitted therethrough and to minimize the dark areas caused by the spacer arrangement. As in device 100, spacer plate 308 and spacer structures 306, 307 and spacer members 311 all have at least one portion along a line normal to the face and back plates abutting each other and the face and back plates to provide rigid mechanical support for the face and back plates when the chamber between the face and back plates is evacuated.

FIG. 3C is a schematic view of four pixels 350 each including three pixel dots 351 and their respective control grid electrodes for controlling the scanning and brightness of these pixels. Instead of having three wires overlapping each hole 201 corresponding to each pixel dot as shown in FIG. 2A, each of the groups G2', G2" and G2'" includes five wires electrically connected and overlapping each pixel dot 351 (corresponding to each hole 201 of FIG. 2A) for controlling the brightness of the pixel dot that overlaps and matches such hole. As shown in FIG. 3C, the top half of each pixel is addressed by one group of scan lines, such as lines G131, and the bottom half by scan lines G132. While both the upper and lower halves of the pixel 350 may be scanned at the same time by applying identical voltages to the two groups of wires G131, G132, the two halves of the pixel may be addressed separately and treated essentially as two different pixels to increase resolution.

FIG. 3D is a schematic view of four pixels 350' each including four pixel dots 352 and the control grid lines for scanning and controlling the brightness of these pixels 352 to illustrate an alternative embodiment of the invention. As shown in FIG. 3D, each of the follr pixels 350' includes a red, a blue and two green pixel dots 352. In such event, the group of electrodes for scanning the pixels should cause all four pixel dots to be scanned in order for the pixel to provide the desired correct illumination. Where the scheme of FIG. 3D is used, each hole in the spacer plate 108, 200 or 308 in FIGS. 1A, 2A or 3A should be divided by two substantially perpendicular separating walls into four smaller holes aligned with and overlapping one of the four pixel dots 352 of each pixel 350' in FIG. 3D. Obviously, other arrangements of pixel dots in the pixel may be used and other arrangements of separating walls dividing each larger hole 250 corresponding to a pixel into smaller holes matching such pixel dot arrangements may be used and are within the scope of the invention.

As shown in FIGS. 1A, 3A, spacer members 111, 311 are thicker than the bars in structures 106, 107 and 306, 307 respectively. In order to reduce any dark shadows caused by spacer structures 106, 107, 306, 307, the grid electrodes close to the bars of these structures are spaced apart at closer spacings than those further away from the bars. For the same reason, higher electrical potentials may be applied to the grid electrodes closer to the bars than those applied to the grid electrodes further away from the bars. Both features would tend to cause a greater percentage of the electrons generated by the cathode to impinge upon portions of the pixel dots that are closer to the bars, thereby compensating for the effect of the bars in blocking the electrons.

With the spacer means described above, the face and back plates may be made of glass plates that are less than about 1 mm in thickness. The grid electrodes in each of the three sets may be made of gold-plated tungsten wires of cross-sectional dimensions greater than about 5 microns. The holes 201 of FIG. 2A have dimensions greater than about 0.2 millimeters. While multi-colored phosphors are illustrated in FIGS. 3C, 3D, it will be understood that monochrome phosphors may also be used for monochrome display and is within the scope of the invention.

The sharpness and resolution of the images displayed are dependent upon the relative directions of the three sets of grid electrodes and of the cathode filaments. The four arrangements described below achieve acceptable resolution and focusing:

1. The cathode filaments are placed horizontally substantially parallel to the first and second sets of grid electrodes G1, G2. The first and second sets of grid electrodes G1, G2 are used for line scanning. The third set of grid electrodes G3 is perpendicular to the first and second sets and is used for modulating brightness of the pixel dots that are scanned.

2. The cathode filaments are placed horizontally and substantially parallel to the first and third sets of grid electrodes G1, G3; the first and third sets of grid electrodes G1, G3 are used for line scanning. The second set of grid electrodes G2 is substantially perpendicular to those of the first and third sets and is used for modulating the brightness cf the pixel dots.

3. The cathode filaments are placed substantially vertically and are substantially perpendicular to the first and second sets of grid electrodes G1, G2; the first and second sets of grid electrodes are used for line scanning. The third set of grid electrodes G3 is substantially perpendicular to the first and second sets and is used for modulating brightness of the pixel dots.

4. The cathode filaments are placed substantially vertically and are substantially perpendicular to the first and third sets of grid electrodes; the first and third sets of grid electrodes G1, G3 are used for line scanning. The second set cf grid electrodes G2 is substantially normal to the first and third sets and is used for modulating pixel dot brightness.

It may be preferable for the cathode filaments to be placed vertically to reduce sagging. The second and fourth electrode arrangements of using the first and third groups of grid electrodes for line scanning and a second set of grid electrodes for modulating pixel dot brightness have the advantages of low modulating voltages, low currents, and simple driving circuits.

Devices 100, 300 of FIGS. 1A, 3A may be simplified by using only two sets of grid electrodes instead of three, such as by eliminating the third set of grid electrodes 104, 304 respectively. In such event, to retain good resolution and focusing properties, the first set of grid electrodes 103, 302 are parallel to the cathode filaments and arranged in the following manner:

1. The cathode filaments are placed horizontally and substantially parallel to the first set of grid electrodes where the first set of grid electrodes G1 are used for line scanning. The second set of grid electrodes 102, 303 is substantially perpendicular to the first set of grid electrodes are are used for modulating brightness of the pixel dots.

2. The cathode filaments are vertically placed parallel to the first set of grid electrodes where the first set of grid electrodes G1 are used for modulating brightness. The second set of grid electrodes G2 is substantially perpendicular to the first set and is used for line scanning.

In the embodiments described above, different spacer arrangements are used to provide mechanical support for the face and back plates when the chamber enclosed by these plates is evacuated. The spacers may in some instances become obstacles to electrons emitted by the cathodes and cause dark areas in the cathodoluminescent visual display which is undesirable. To reduce or even eliminate such dark areas, the electric field surrounding the cathode filaments is altered to cause a greater number of electrons to impinge portions of the phosphor dots that are closer to the spacer elements than portions of the pixel dots further away from such spacer elements.

Figure 4:
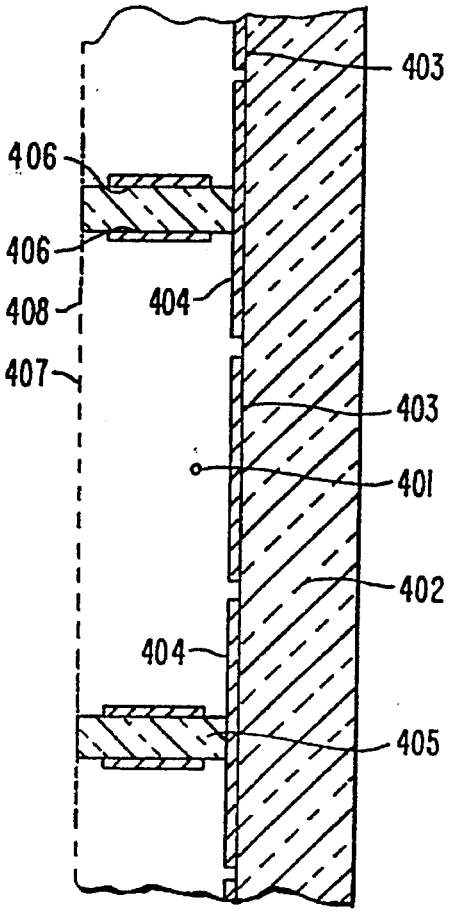
FIG. 4 is a cross-sectional view of a portion of the device of FIGS. 1A and 3A to illustrate the invention.

FIG. 4 is a cross-sectional view of a back portion of the devices 100, 300 of FIGS. 1A, 3A to illustrate one such scheme for all three electric fields surrounding the cathode filaments. In FIG. 4, 401 is a cathode filament. The inside surface of back plate 402 has a conductive layer divided into two groups: 403 and 404. The group of electrodes 403 directly faces the filament and therefore overlap the cathode filaments; the voltage applied to electrodes 403 is the same as that applied to the cathode filaments 401. Electrodes 404 do not overlap cathodes 401. Appropriate voltages are applied to electrodes 404 so that they are at a high electrical potential compared to cathode filaments 401 and electrodes 403 so that they would tend to attract electrons emitted by the filaments 401, causing more electrons to impinge phosphor dots on the anode at locations closer to spacer members 405. In the preferred embodiment, both groups of electrodes 403, 404 are substantially parallel to the cathode filaments 401 and effectively reduce shadows caused by the presence of spacer members 405 at the spacer bars 106, 107, 306, 307 also parallel to the cathode filaments.

An additional set of electrodes 406 present on both sides of spacer members 405 is also caused to be at higher electrical potentials compared to cathode filaments 401 to further attract electrons emitted by the cathode filament and cause them to travel in directions closer to spacer members 405 so as to reduce the shadows caused by the spacer members.

The first set of electrodes comprising electrodes 407, 408 are also spaced apart by such spacings as to cause more electrons to travel closer to the spacer members 406. This is achieved by causing the grid wires 408 to be at closer spacings at locations closer to the spacer members than grid wires 407 at locations further away from the spacer members. As shown in FIG. 4 this is illustrated by locating the grid electrodes so that the electrodes 408 are closer together than electrodes 407.

Yet another technique for reducing shadows caused by spacer members 406 is to apply voltages such that grid electrodes 408 are at higher electrical potentials than grid electrodes 407. The last described method concerning the grid electrodes may also be used for reducing shadows caused by spacer bars which are transverse to the cathode filament 401 by causing grid electrodes parallel to such bars to be at closer spacings at locations close to such spacer bars than at locations further away from such spacer bars and/or by applying higher voltages to such grid electrodes closer to the spacer bars than voltages applied to grid electrodes further away from the spacer bars.

A large screen CRT type television would require cathode filaments over long distances. In such event, it is desirable to employ shorter segments of cathode elements arranged in a linear array instead of one long filament because a longer filament would tend to sag. To allow for expansion and contraction of the cathode filaments, the ends of the filaments are connected to the printed circuit board, such as board 116 in FIG. 1A, by means of springs. Conventional springs typically have low resistance and would therefore be heated to a lower temperature compared to the core of the filament. This temperature differential between such spring and the end portion of the filament core will cause such end portions of the core to be at a lower temperature as well, thereby reducing the effectiveness of this portion of the filaments in emitting electrons. This factor is taken into account in constructing the linear array of cathode filaments to take the place of a very long cathode filament in a manner illustrated in FIG. 5.

Figure 5:
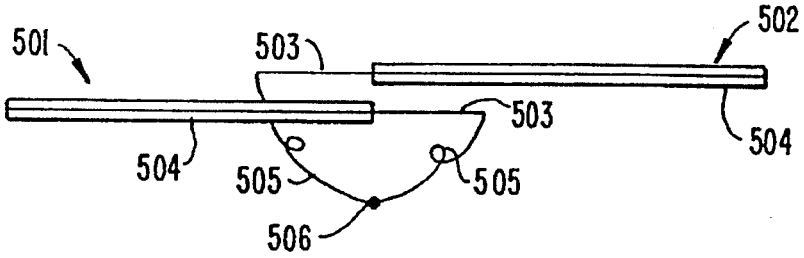
FIG. 5 is a schematic view of a portion of the cathode in FIGS. 1A, 3A.

FIG. 5 is a schematic illustration of two cathode filament segments 501 and 502. Each of the two cathode filaments includes a core 503, each connected at one end through a spring 505 to a support 506. Each filament also has a coating 504 made of a material which emits electrons when heated. As shown in FIG. 5, the two filaments are placed substantially in a linear array along the same straight line with one end of filament 501 close to an end of filament 502 where the two ends partially overlap to reduce undesirable effects caused by the ends of the filament core 503 being at a lower temperature compared to the intermediate portion of the filament, thereby reducing or eliminating any visible gaps between images displayed by the device using filaments 501, 502. Preferably, the overlapping portions of the two ends of the two filaments 501, 502 are such that the coating 504 of one filament is close to the end of the coating of filament 502 so that, as seen by the pixel dots on the anode, filament segments 501, 502 appear as one filament and as one single source of electrons with no gaps in between.

While springs 505 may be made with the same material as core 503, in some instances springs 505 may be made of stronger or thicker material compared to core 503; all such variations are within the scope of the invention. In such manner, filaments 501, 502 together form essentially a single electron source for emitting electrons uniformly along their lengths.

Figure 6:
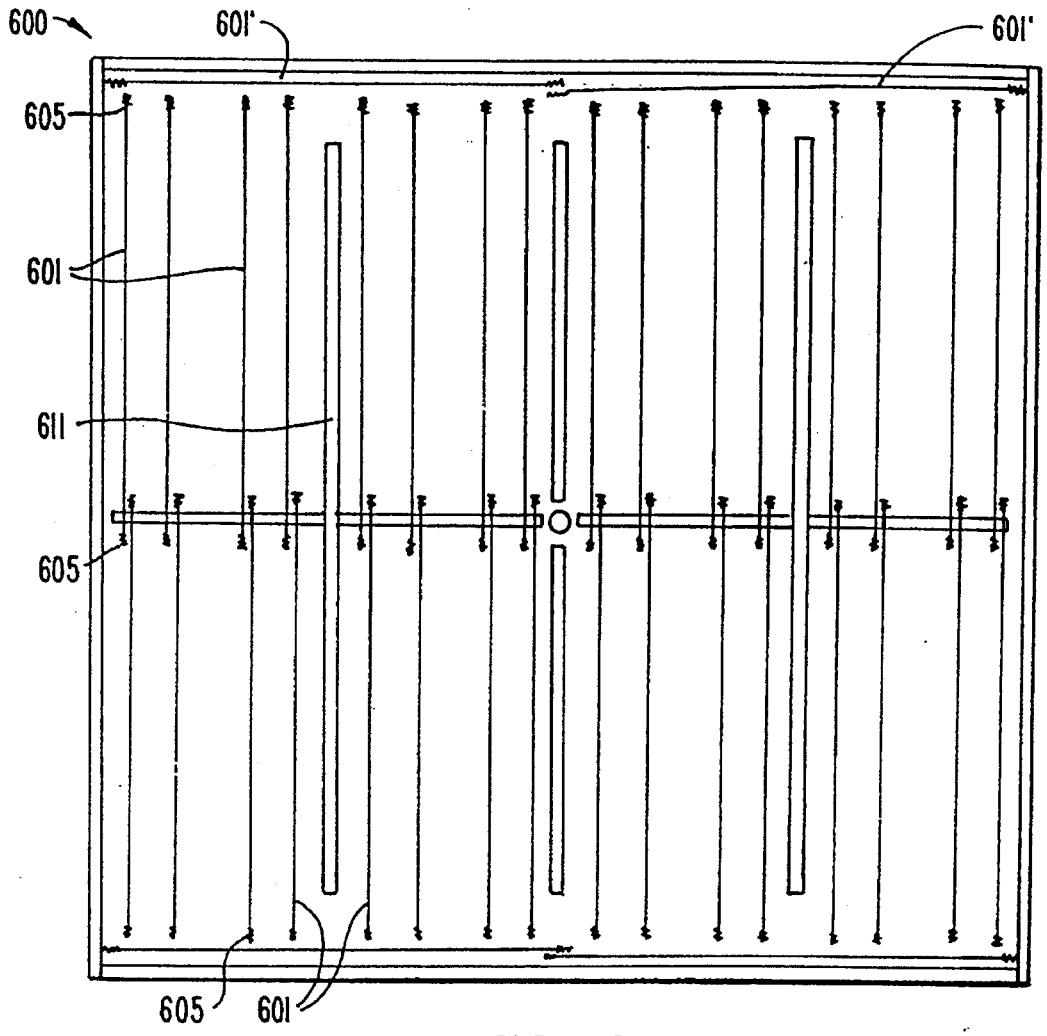
FIG. 6 is a schematic view of a cathodoluminescent display illustrating the use of additional cathodes to reduce the dark areas caused by the use of springs for mounting cathode filaments.

FIG. 6 is a schematic view of a cathodoluminescent display 600 illustrating the use of additional cathodes to reduce dark areas caused by the use of springs for mounting the cathode filaments. As shown in FIG. 6, display 600 includes an array of cathode filaments 601, each of which is mounted onto the housing by means of springs 605, where each end of the filament 601 is connected to the housing by means of a spring 605. As discussed above, the springs and the end portions of the filament connected to the springs may be at a lower temperature compared to the intermediate portion of the filament, so that fewer electrons will be emitted from the end portions, thereby causing dark areas in the display. Such dark areas may be reduced by adding additional cathode filaments such as filaments 601' adjacent to springs 605 where the filaments 601' are preferably located adjacent to the springs 605 on one side of the array of cathodes 601 to reduce the dark area of the display caused by the array of springs 605 on one side of the array of filaments 601. As shown in FIG. 6, two pairs of filaments 601' are employed, one pair at the top portion and one at the bottom portions of the display to reduce the dark areas in such portions of the display. It will be noted that the filament 601 overlaps in a manner described above in reference to FIG. S in the middle portion of the display so that additional cathodes may not be needed in such areas, although adding additional cathodes would serve to enhance the display.

Figure 1A:
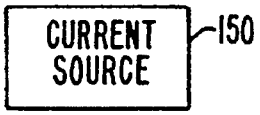
Figure 7:
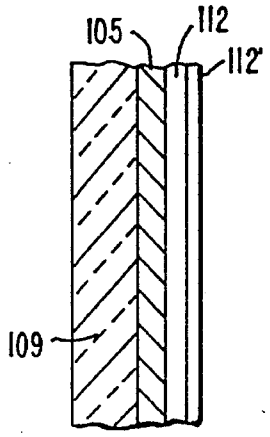
FIG. 7 is a cross-sectional view of a portion of the cathodoluminescent display of FIG. 1 to illustrate the preferred embodiment of the invention.

FIG. 7 is a cross-sectional view of a portion of the face plate, anode and phosphor layer of FIG. 1 to illustrate the preferred embodiment of the invention. When device 100 is in operation, the phosphor layer 112 is incessantly bombarded by electrons. Therefore, to lengthen the useful life of the phosphor layer 112, a protective layer 112' made of magnesium oxide or zinc oxide is employed. If a magnesium oxide layer is desired, magnesium oxide material may be deposited onto the phosphor layer 112 by means of vacuum evaporation. If the protective layer is to be made of zinc oxide, zinc material may be deposited onto the phosphor layer 112 by means of vacuum evaporation. Upon subsequent oxidation of the zinc material due to the oxygen in the air, the zinc deposited will form a protective zinc oxide layer 112'. It is preferable to employ magnesium oxide or zinc oxide as the protective layer, since such material can be penetrated easily by electrons with energy in the 2 keV–3 keV range, where the voltage across the anode and cathodes is of the order of 2 kV–3 kV volts. For cathodoluminescent displays operated at such voltages, magnesium oxide and zinc oxide are preferable to other materials such as aluminum oxide which is opaque to the penetration of electrons in such energy range. Magnesium oxide and zinc oxide are resistant to the bombardment of electrons and are effective in protecting the phosphor layer in order to increase its useful lifetime.

The above-described flat panel television panel may also be Used for constructing a mosaic large-screen display, where a number of devices 100 or 300 may be arranged in one plane in a two-dimensional array to form such mosaic large-screen display. While the invention is illustrated above by reference to multicolor displays, the invention is also applicable to monochrome displays as well where the red, green and blue phosphor dots on the anode are replaced by monochrome phosphor dots.

This above-described invention involves an EFD (Electron-Fluorescent Display) that will allow the technology to attain high resolution and high quality image. While many parts of this invention are particularly useful to the mosaic tile embodiment of the EFD technology, there are many aspects of this invention that can also be applied to other embodiments of this technology. The applicants have discovered further improvements to the above-described EFD.

The improvements to the EFD invention described above can be divided into the following aspects:

1. A new side wall structure that allows the mosaic tile embodiment to greatly reduce the inter tile gaps and therefore improve the resolution of such devices.

2. Interconnect and alignment features that become critical since the resolution is greatly enhanced and the assembly tolerance significantly reduced.

3. Image, contrast and uniformity enhancement features that become more important due to the increased resolution.

There are two ways to create a display system, one is to make a single piece device, the other, to assemble multiple display devices into a mosaic tiling system. Due to the constraints of production equipments, single piece devices inevitably have limitations in attainable maximum dimensions. The mosaic tiling approach, on the other hand, can achieve very large system size, while having problems achieving high resolution in small display systems. The main bottleneck that is responsible for resolution limitations in the mosaic approach are the gaps between tiles. These gaps will become disturbing dark lines when tiles are assembled together. In EFD technology, there are three causes for gaps between tiles: (1) the physical side walls of the display devices; (2) the rate at which cathode can emits electrons around edges of a tile is lower; and (3) the change of brightness due to the interaction between cathode electrons and side wall structures. With the features introduced in this invention, the above problem areas will be addressed and solutions for high resolution EFD mosaic systems provided. However, after solving these major problems, some of the secondary problems become more disturbing. These problems include (1) the difficulty in assembly due to the reduced tolerance of the high resolution tiles; (2) the contrast of the display needs to be improved for bright viewing environments; (3) uniformity problem due to non-uniform cathode electron density profile received at the anode; and (4) color shift due to difference in the rate of change of phosphor efficiencies. Several features of the further improvements will help solve each of these problems. The last aspect of this improvement deals with a novel phosphor pattern that will better match the human visual characteristics and enhance the perceived resolution of a full color display system.

In addition to a brief review of EFD structures, the following discussions include the following parts: (1) the new side wall structures, (2) alignment and assembly issues, (3) addressing resolution considerations, (4) features that deal with uniformity and phosphor lifetime balancing, and (5) contrast and image enhancements.

BASIC EFD STRUCTURES: EFD structures were introduced above and in the parent applications. The display device has a vacuum chamber comprises two face plates and side walls. The internal surface of front face plate usually contains a transparent conductive coating as the anode. Near the back face plate, there is a electron cloud generating cathode which usually comprise of filaments arrayed in a plane parallel to the back face plate. Two or more layers of control electrodes are layered between the cathode and the anode to control and accelerate the cathode electrons toward the phosphors coated on the anode. Spacers made of glass rods, photo etched glass plates or otherwise formed structures are placed between these planes of anode, control electrodes and cathodes. These spacers are physically stacked on top of each other and preferably sandwich the control electrodes in-between. These spacers not only serve as the means to maintain the location of the control electrodes, but also form a solid support structure between the two face plates. Due to this solid structure, EFD technology can be applied to display devices of fairly large dimensions without resorting to the use of face plates thicker than a few millimeters.

Figure 8A:
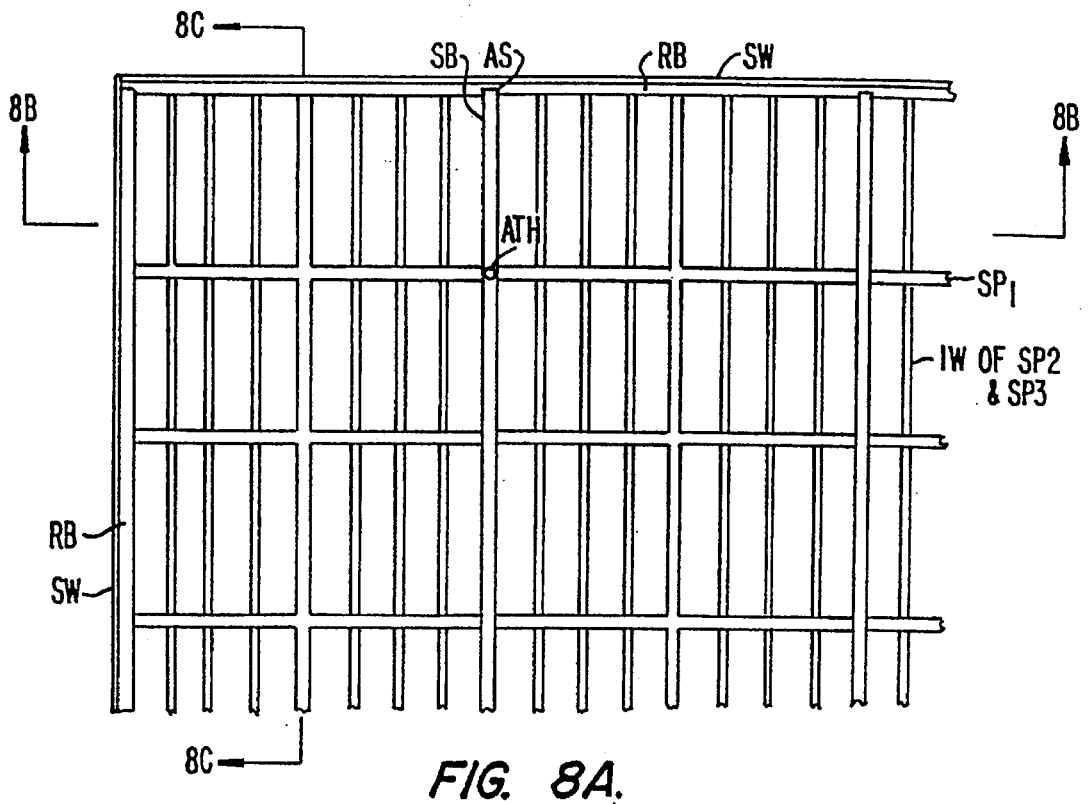
FIG. 8A is a view of a EFD mosaic tile from the cathode side. Control grid electrodes are left out for the sake of clarity.
Figure 8B:
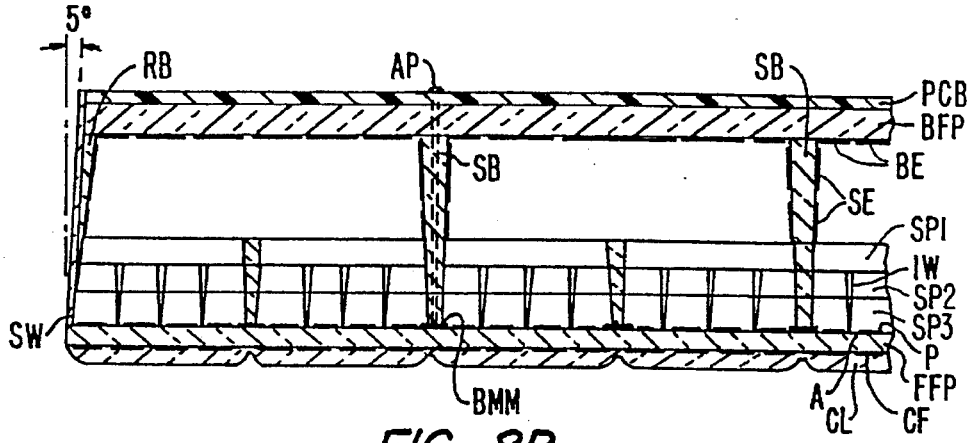
FIG. 8B is a cross-sectional cut away view from perspective 8B—8B in FIG. 8A.
Figure 8C:
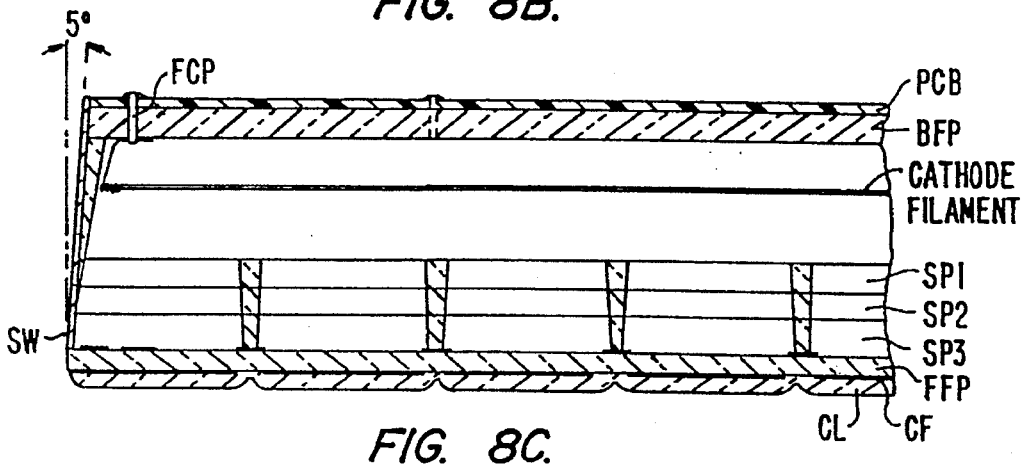
FIG. 8C is a cross-sectional cut away view from perspective 8C—8C in FIG. 8A.
Figure 9A:
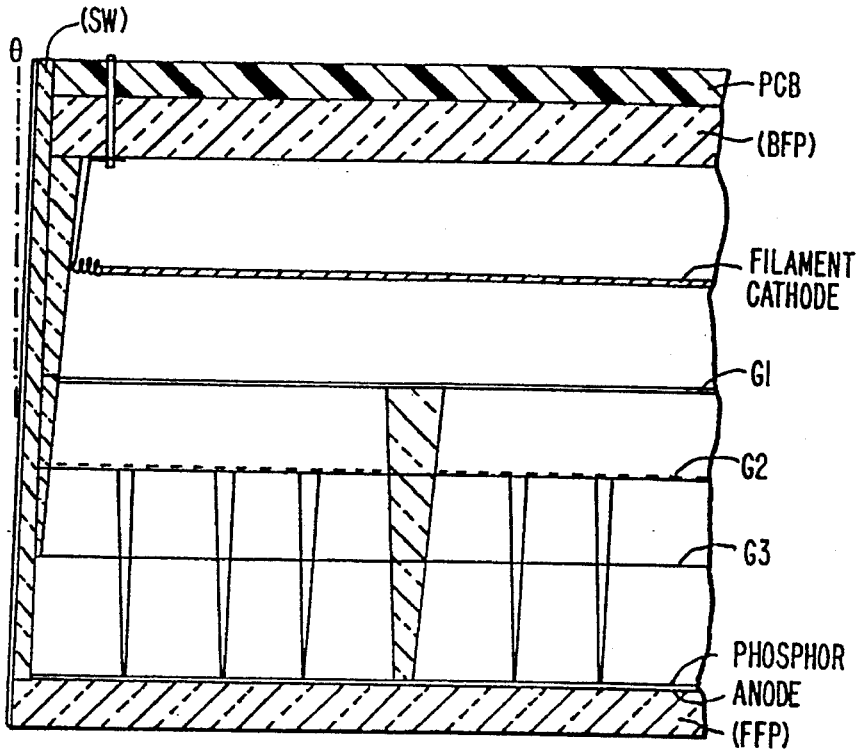
FIG. 9A is a detailed look of the side wall structure of FIG. 8A.
Figure 9B:
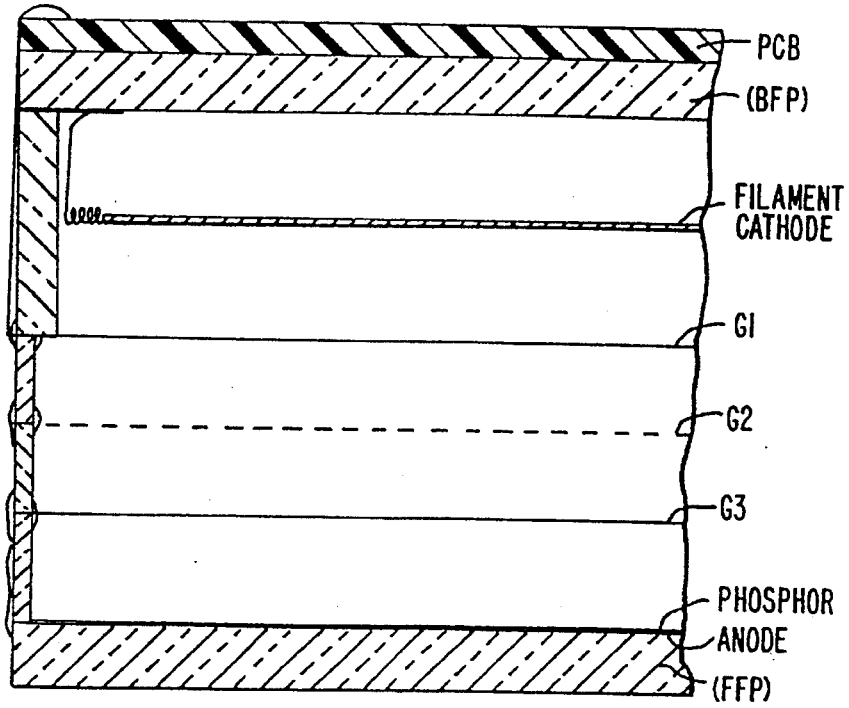
FIG. 9B. (PRIOR ART)
FIG. 9B shows a conventional side wall structure to serve as a comparison to that of FIG. 9A to show the improvement of this invention.

THE NEW SIDE WALL STRUCTURE: The new side wall structure for EFD mosaic tile includes four one piece structures extending from each edge of the front face plate toward the corresponding edge of the back face plate or even beyond. This side wall structure (SW in FIGS. 8A–8C) can be made of glass or ceramic material with a thickness from about 0.2 mm to 2 mm. The inside surface of this side wall structure can be coated with conductive wiring traces to connect to internal electrodes from outside. In the example of FIGS. 8A–8C, the side wall structures, together with the circuit traces printed on them, are extended beyond the back face plate, and a printed circuit board (PCB) is attached to the back face plate, this configuration allow the control electrodes to be connected to the PCB through the wiring traces printed on the side walls. Since the side wall can be made very thin, this structure will allow the inter-tile gaps (ITG in FIGS. 17A–17C) between EFD mosaic tiles to be precisely controlled down to around 1 mm range. The restrictions for the minimum thickness of the new side wall structure come from the following considerations:

(1) the ability to withstand the atmosphere pressure and other lateral forces acting on the sides of the device after the device is evacuated, (2) the ability to withstand the abuse of inter-tile friction, dust particle scratches, etc., and (3) the ability to maintain a high vacuum sealing with the front face plate.

Figure 17B:
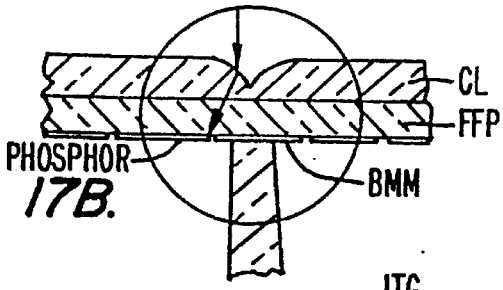
FIG. 17B is a closed up view of the compensation lens and FIG. 17C is an alternative implementation of the compensation lens in the form of a Fresnel lens.
Figure 17A:
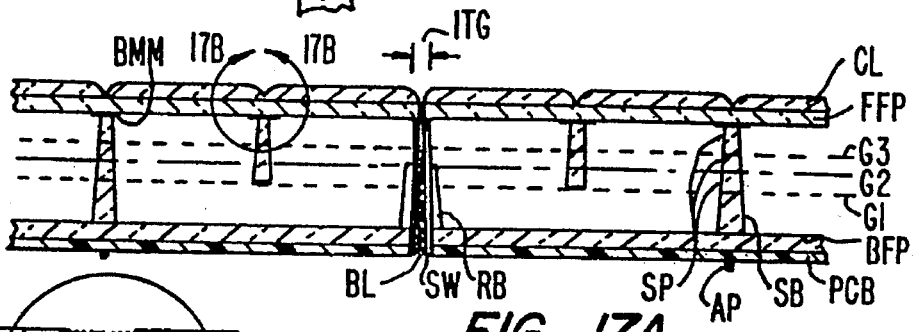
FIG. 17A shows the compensation lens of display tiles and the inter tile gaps between display tiles.
Figure 17C:
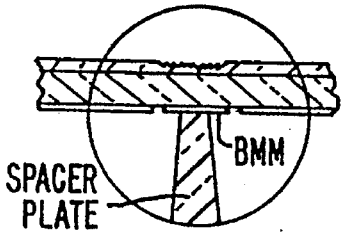

The first consideration gets help from two features of this invention: (a) the side wall structure have closely spaced internal supports formed by multiple layers of spacers or spacer plates (SP in all FIGS. 8A–8C and 10), (b) additional reinforcement bars (RB in FIGS. 8A–8C, 9, 10) can be added to the side wall where there is no internal spacer support. These layers and RB are attached to all four side walls at locations surrounding the vacuum chamber. The second consideration is solved by tilting the side walls for about 3 to 10 degrees (θ being 5 degrees in FIGS. 8B, 8C) such that the front face plate is slightly larger than the back face plate. These slightly tilted side walls will not affect the apparent gaps between tiles when viewed from the front of the device. A tiny gap, however, will be developed by the tilt (FIGS. 17A–17C). This gap, which may be filled with buffering or protective material, will help to reduce the impact of the various mechanical abuses. The third consideration is handled by properly select the sealing methods between the side walls and front face plate. The sealing may take one of three forms: (1) along roughly the same plane as the anode, seal the narrow edge surface of the side wall to the front face plate, (2) along a plane that is roughly perpendicular to the anode, seal the side wall to the edge surface of the front face plate; or (3) grind or otherwise make a pair of matching slanted surfaces along the edge of these two structures and seal them together with this pair of surfaces. Among these methods, the first one gives the best viewing angle but the least sealing strength. The second method has the strongest sealing but viewing angle will suffer unless the front face plate edge surface is optically polished and transparent sealing material is used. The third method is a compromise between the first and the second method.

Compared to conventional EFD mosaic embodiments where the side wall consists of several piece of glass stacked on top of each other with control electrodes sandwiched in-between (FIG. 9B), the new structure has the following advantages:

(1) One piece structure (per side) greatly reduces the chance of misalignment and leakage while increase the mechanical strength of the structure.

(2) Electrodes, which usually are made of metal or alloy, no longer protrude out of the side walls. Gone with this is the excess sealing glass frit which is usually necessary in order to maintain a well sealed vacuum chamber. These protrusion and excess glass frit were the primary reasons for the difficulty in attaining tight dimension control.

(3) Internal control electrodes are now brought out directly from the back of the tiles either through the wiring traces printed on the inside surface of the side walls (FIGS. 8A–8C) or through the finger of the electrode (FIG. 24C). The connection to these electrodes can now be completed easily with bounding techniques commonly used in nowadays flat panel technology.

ALIGNMENT AND ASSEMBLY: With the new side wall structure, EFD can now achieve high resolution mosaic tiles. The next problem is how to guarantee the precision of parts and the alignment between these parts such that high resolution potentials of EFD devices can be fully realized. The current state of the art photolithography provides precision beyond the need of current EFD devices. Most of the precision parts necessary for EFD can be made by technology such as the Fotoform glass of Corning, USA. Together with these high precision parts, the features listed below will allow precise alignments to help produce high quality displays.

(1) The spacer layers and the back face plate can have alignment through holes (ATH in FIGS. 8A, 10, 12A and 25) in them. Together with precision drilled or etched holes (AH in FIGS. 10, 25) in the front face plate (EFP), these holes can be used to hold their relative locations by inserting alignment pins into these holes (AP in FIGS. 8B, 10, 25). These alignment holes can also be used to connect to the anode by using metal core glass tube as the alignment pins (AP in FIGS. 8B, 10, MAP in FIG. 25). In this case, these holes not only serve as the alignment means but also as the insulation walls for the electrically conducted metal core serving as the anode connection which can carry a voltage around 500 V to 5,000 V relative to cathodes and control electrodes.

(2) The reinforcement bars for the side walls can have a thickness exactly equal to the distance between the back face plate (BFP) and the spacer plates (FIG. 8A–8C and 10). This can help to guarantee the precise distance between these two planes.

(3) The reinforcement bars for the side wall can have slots (alignment plots AS in FIGS. 8A and 10) to help align the spacer bars (SB in FIGS. 8A and 10) with the walls in other spacer plate layers. These slots, the reinforcement bars and spacer bars can have their dimensions designed in such a way that after they are put together, this structure can also serve as a mold for the rest of the side wall assembly (FIG. 10).

(4) The role of reinforcement bars in mosaic, in terms of aligning spacer bars, can be replaced by edge spacer bars (serving also as side wall) in single piece embodiment of EFD (ESB in FIG. 25). In addition to spacer bar alignment slots, these edge spacer bars (ESB) can have additional through holes for alignment with other layers of spacer plates (ATH in FIG. 25).

Figure 26:
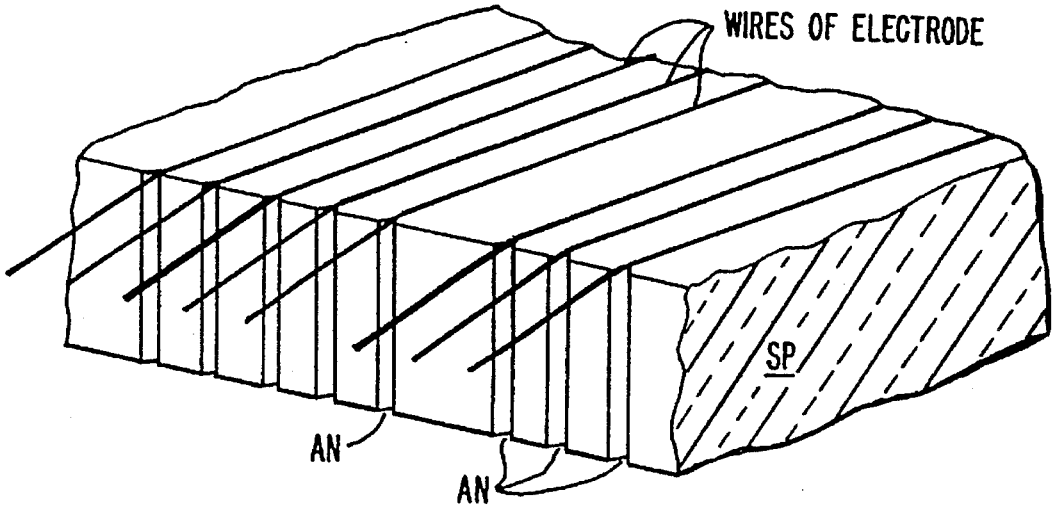
FIG. 26 is a closed up view of alignment notches and their relationship to the wires of control electrodes.

(5) At the edge of spacer plates, alignment notches (AN in FIG. 26) can be etched to help align and anchor the wires of control electrodes. After wires are properly placed inside these notches, the chance for these wires to move during assembly and sealing process will be greatly reduced.

Figure 10:
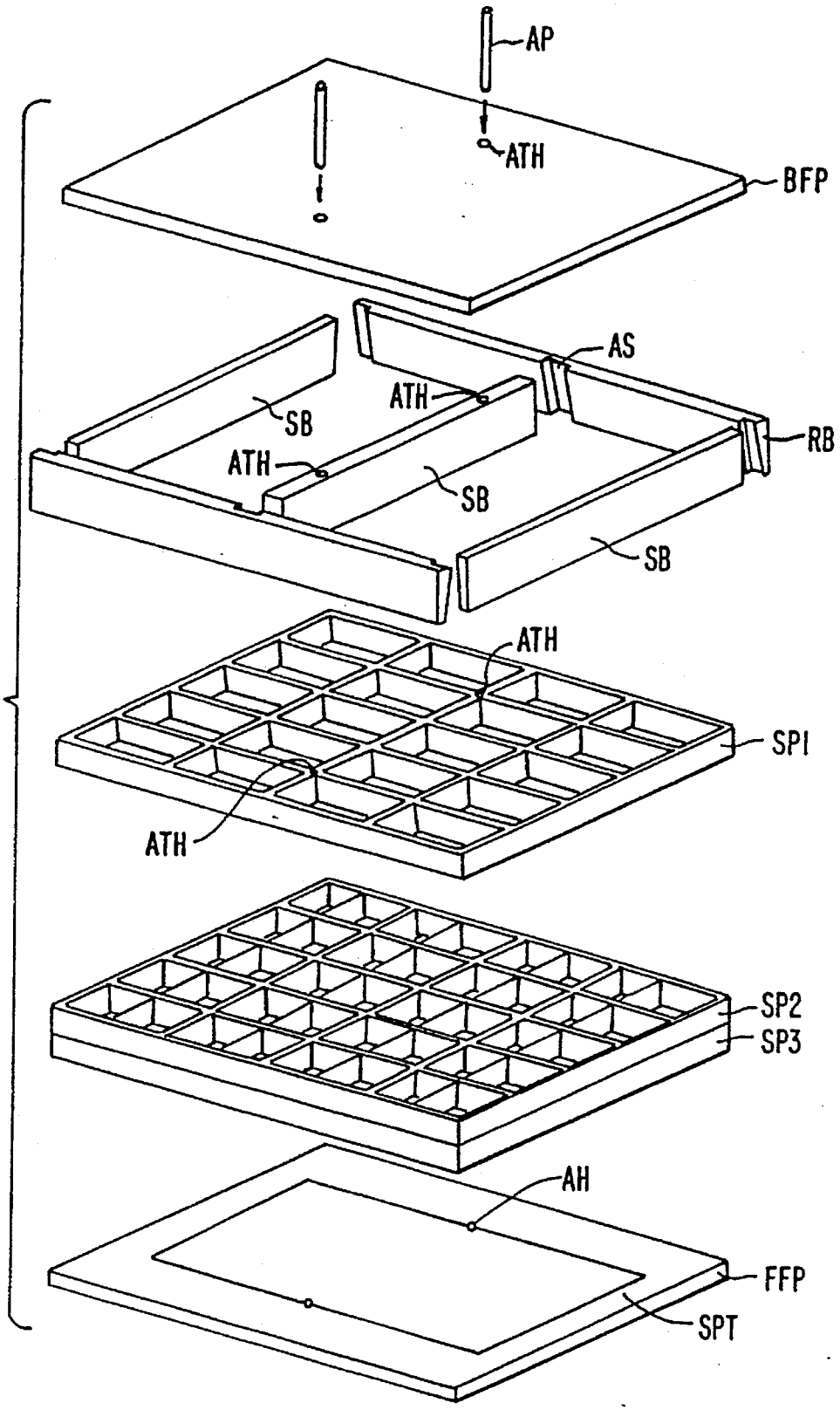
FIG. 10 is an exploded view of the stacking relationship between various parts of the device of FIGS. 8A–8C to show the alignment features. This drawing is abbreviated and does not show the detail of spacer plates.

The device is assembled as illustrated in FIG. 10. First the various components shown are provided. The spacer plate is formed by etching using photolithography. Then the components are aligned using alignment pins and glued together using an adhesive such as glass frit.

HIGH RESOLUTION ADDRESSING: With the high precision spacer plates, the new side wall structure and precise alignment means, high resolution displays can now be made. But all these good things will be wasted unless electrons generated by cathode can be precisely directed toward right positions at the anode. In EFD, this is achieved by the layers of control electrodes and the spacer plates as described below.

EFD structures can accomplish matrix addressing through two or more layers of control electrodes in the form of parallel fine metal wires or net shaped structures made of metal wire cloth, etched or perforated foil. Within each layer, control electrodes are parallel to each other. Between layers, control electrodes may intersect each other at a right angle. The intersection area defines the pixel, the minimum controllable display unit.

Figure 11A:
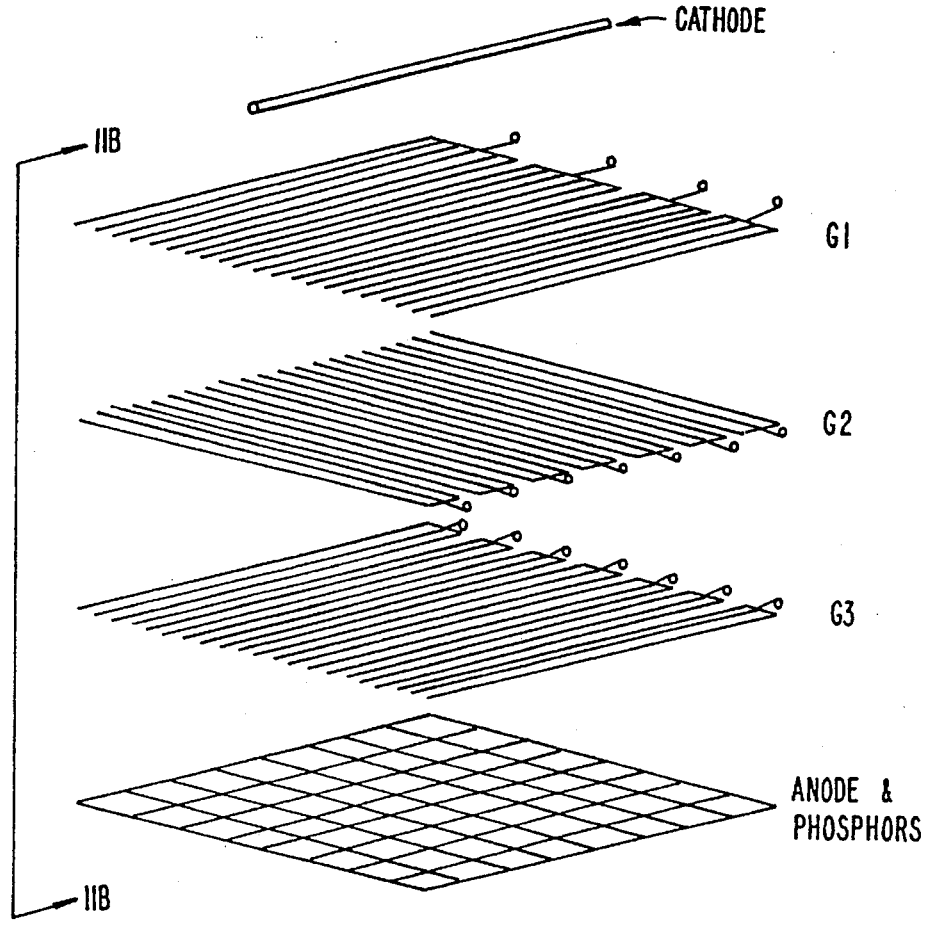
FIG. 11A shows the arrangement of cathode, three layers of control electrodes and the anode.
Figure 11B:
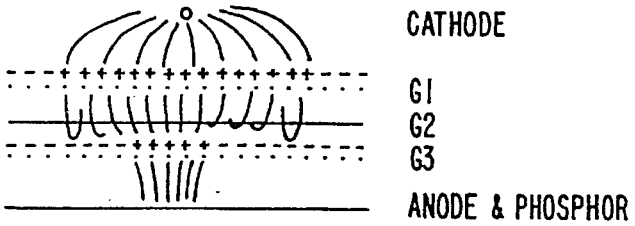
FIG. 11B shows the focusing effect of scanning control electrodes from perspective K of FIG. 11A.

EFD shares with vacuum tube technology some design principles, for example, the characteristics of grid electrodes with respect to the pitch of the grid wires and to the distances between layers of grid electrodes. One major difference between EFD and the vacuum tube is that, in EFD, an electrode with an off voltage (eg. voltage lower than that applied to the cathode) will not only turn off the pixel it controls but also affect the neighboring pixels by pushing electrons away. This effect is very useful in the line by line scanning operation, since at any time a selected row is surrounded by unselected rows, the off voltage applied to unselected rows not only cut off those rows but also focus the electrons of the selected row and, therefore, significantly reduce the crosstalk between neighboring scan lines (FIG. 11B).

In practical applications of pentode EFD (FIG. 11A, 11B), the center control grid layer (G2) is usually used for intensity modulation, and the first control grid layer (G1), which is between G2 and the cathode, and the third control grid layer (G3), which lays between G2 and anode, are usually used for scanning operation. In this configuration, due to the shielding provided by G1 and G3, current and voltage requirements for G2 can be controlled to be within the range of $V_{p\text{-}p} \leqq 50$ V and $I_{p\text{-}p} \leqq 1$ mA. This moderate driving characteristic allows VLSIs (vary large integrated circuits) to used as display drivers. One example of a matrix addressing configuration is to have G2 oriented vertically for intensity modulation and G1, G3 oriented horizontally, connected in a pair by pair fashion, for line scanning operation as described in one of the parent applications.

Since G1 is placed close to the cathode, it has strong effect both on the electron distribution and on the rate of the electron generation of the cathode. It is sometimes desirable or even necessary to let G1 cover a wider area than what is actually scanned by G3 (FIG. 11A). For example, an EFD display of L*N lines may have L*N G3 electrodes of width W and N G1 electrodes of width L*W. G1 and G3 are scanned in such a way that when line M is scanned $G3_M$ (the G3 electrode for addressing line M) will have $V_{on3}$ voltage and $G1_{K-1}$, $G1_K$ and $G1_{K+1}$ will have $V_{on1}$, where $K=\lfloor M/L \rfloor$, and $V_{on1}$, $V_{on3}$ are the turn on voltage for G1 and G3 respectively. This will produce a situation similar to the one shown in FIG. 11B. The wider G1 scan line produces an averaging effect of the cathode electron clouds over a wider area. As is commonly recognized, the wider the averaging range, the lower the variation will be, and, in terms of EFD, the better the uniformity will be. When electrons are under G3, electrons can pass through only a smaller area than the area for G1 through which electrons can pass. The display brightness will also be increased since wider G1 scan line will allow more cathode electrons to pass through the grids and hit the anode than where G1 permits electrons to pass an area as small as that permitted for G3.

Another benefit of this arrangement is the reduction of the number of scanning drivers necessary. This is because beth G1 and G3 need to be turned on at the same time in order for a line to be scanned which implies many G3 electrodes can share a common driving signal and therefore reduce the number of drivers. For example, let L=4 and N=120, that is every G1 electrode is four time the width of a G3 electrode. Then we will need 4 G3 drivers and 120 G1 drivers, or a total of 124 drivers, to scan the L*N=480 lines in a line by line scanning operation.

The role of G2 and G3 can be exchanged. In this configuration, G3 will be responsible for modulating intensity and G2 will be responsible for line scanning. The orientation of these grids need to be changed accordingly so that G2 electrodes will be parallel to G1 electrodes and G3 electrodes will be perpendicular to G1 and G2 electrodes. There are other possible configurations that can be used to perform the matrix addressing of pentode or tetrode EFDs. These options will be familiar to engineers well trained in vacuum tube circuit design.

In terms of addressing resolution in an EFD device, G3 is the best, followed by G2, and G1 is the worst. This comes as an expected result when we consider that the distances between anode and G3 is the shortest. The anode voltage also helps by accelerating the electrons which shortens the time it takes to travel to anode and reduce the degree of scattering. In an EFD device, where the distances between cathode, G1, G2, G3 and anode are usually in the range of 0.5 mm to 5 mm, phosphor dot pitches down to around 2 mm can be achieved with control grids alone. To attain higher resolutions, spacer plates with fine partition walls will be desirable.

The function of spacer plates as structural supports has been described above. Another important function of spacer plates, especially those made by the Fotoform are to provide isolation walls (IW in FIG. 5) between pixels and phosphor dots. One or more layers of spacer plates (SP in FIGS. 12A, 12B) with patterns of thin isolation walls may be employed in an EFD. These partition walls confines the trajectories of electrons traveling between them by forming tunnels between neighboring walls. The shapes and dimensions of these tunnels are designed to allow fine resolution addressing of phosphor dots. Since the minimum feature size of current Fotoform technology is about 1 mil, or 0.025 mm, the addressing resolution of EFD structure using Fotoform spacer plates can go down to 0.2 mm range.

A few characteristics of thin isolation walls need to be controlled in order to achieve the resolution desired. Since Fotoform glass is a very good insulating material, the surfaces of those isolation walls will accumulate electrons and form electro-static fields. These electro-static fields will behave both as an focusing lens, squeezing passing by electrons, and as barriers to electrons trying to enter the tunnel. These two effects can produce undesirable results. Excessive focusing effect will reduce the effective phosphor dot size. The barrier effect will reduce the current density received at the anode. Since both these effects are related to the amount of charge accumulated on the wall surface, and therefore to the height of the isolation walls, their intensity can be changed by using spacer plates of different thickness or by reducing the height of isolation walls through proper etching techniques. Yet another way to control the static field is, as will be discussed again later, to coat a resistive film (RFC in FIG. 12B) on these isolation walls to stop the static charge from building up.

On the other hand, these effects of static fields can actually be used to an advantage. For one thing, the focusing effect can help reduce crosstalk between neighboring pixels. In addition, since the brightness of phosphor dots are affected by electro-static fields in isolation tunnels, it can be deduced that if surfaces of these isolation walls are plated with electrodes, then these electrodes can be used to control the operation of the display. In other words, the function of control grids in the original EFD [1] can be accomplished by plated control electrodes (PCE in FIG. 12A) on the walls of spacer plates. In an EFD device with phosphor dot pitch under 1 mm these plated electrodes can have an edge over wire electrodes or net shape electrodes in terms of manufacturability and reliability.

UNIFORMITY AND COLOR BALANCING: One important quality factor of a display device is the uniformity of its brightness. For a cathodoluminescent display device, such as CRT or EFD, the brightness is strongly dependent on the current density received at the anode and the phosphor efficiencies. CRT has a single gun cathode structure and there are few obstacles in the space between the gun and the shadow mask or anode. With the help of some compensation circuits, the change of anode current density in CRT is relatively smooth and the change of brightness is usually not detectable by human eyes. In EFD devices, however, there are three major causes for the anode current density to fluctuate. First, due to the use of spacers and the static charge accumulated on their surfaces, there are nonuniform electrostatic fields inside the device. These fields change the distribution of the electrons generated by the cathode. We will refer to this effect as the spacer charging effect. Second, the filament's ability to generate electrons is a very sensitive function of its temperature. Due to the energy lost to the supports, the temperature at two ends of a filament are generally lower than the rest of the filament. This temperature drop cause the electron generation rate to be lowered significantly at the ends. This will be called the cold terminal effect. Third, due to the fact that filament array is but an approximation of a planar cathode, they can not produce truly uniform electron cloud. In an EFD device where cathode is made of filament array or other non-planar electron sources, the distribution of electron current arriving at the anode will generally peak at areas under electron sources and bottom midway between two sources. We will name this the washboard effect. As for phosphor efficiencies, after many years of research, modern phosphors usually have satisfactory performances even in the low operating voltage of EFD. The problem with phosphor efficiency is not so much in the absolute brightness but in the rate of change along the course of display devices operation lifetime. Since color cathodoluminescent device generally employs three different types of phosphors to produce the full spectrum of colors perceived by human eyes, the relative brightness generated by each type of phosphor need to be carefully managed in order to faithfully reproduce the original colors. However, the efficiency of these phosphors may fall at different rates. One example is the blue phosphor whose efficiency usually decrease faster than the red and green phosphor. Under normal operation the display will gradually turn yellowish and, therefore, lose the ability to reproduce colors correctly. To avoid this, the rate of efficiency change for phosphors of different colors should be made as close as possible. The following features are aimed at solving the problems just mentioned.

(1) The reinforcement bars of side walls or side walls per se, the spacer bars and the back face plate may have electrode patterns (SE and BE in FIG. 12B) printed or coated on their surfaces. When properly energized, these electrodes can (a) counter the electrostatic field produced by the spacer charging effects, (b) produce electric field to more evenly spread out electrons generated by each filament to reduce the washboard and cold terminal effect.

(2) The electrodes just discussed (SE and BE in FIG. 12B) can contain high secondary electron emission coefficient materials, such as caesium oxide. This will not only replenish the electrons absorbed by these electrodes but also generate new electrons. In this combination, both the distribution and the rate of generation of free electrons can be changed by voltages applied to these electrodes SE and BE.

(3) The surface of spacer walls can be coated with a layer of resistive material (RFC in FIG. 12B), such as $In_2O_3$, $Pb_2Ru_2O_7$. This coating is connected to control electrodes through contact to stop spacer charging effect. The resistivity of this coating should be high enough to avoid excessive leakage current between neighboring control electrodes while low enough to control the build up of static charges. A value of $10^6$ Ohm/cm will be appropriate.

(4) In addition to the array of filaments, two auxiliary filaments can be added to the cathode structure to compensate for the cold terminal effect. For example, if the cathode consists of an array of vertical filaments, two horizontal filaments can be added to the top and bottom of the array near the ends of the filaments (AF in FIG. 18A) such that all areas are covered by filaments working at proper temperature and therefore eliminate the cold terminal effect.

(5) When a display device is of fairly large dimensions, filaments need to be segmented (FIG. 18A) in order to control vibration, sagging and or mechanical problems. These segments can be overlapped in such a way that one segment's cold terminal is covered by the other segment's working region to avoid cold terminal effects at the ends of these segments.

Figure 18A:
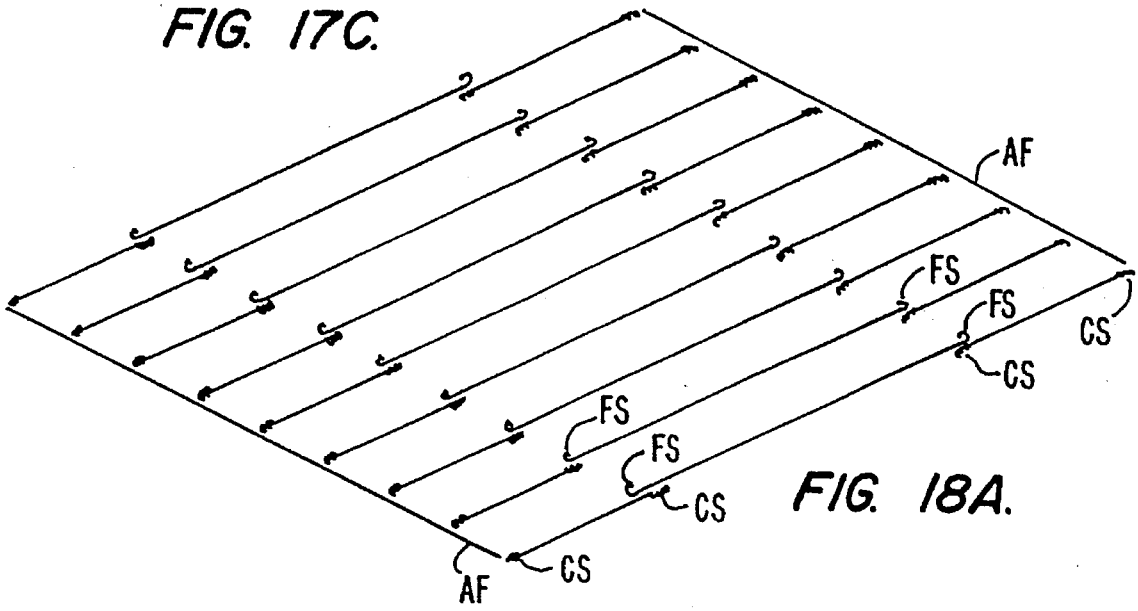
FIG. 18A shows one possible configuration for filament cathode assembly.
Figure 18B:
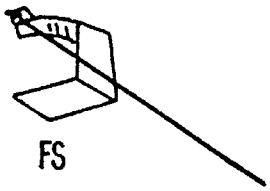
FIG. 18B and FIG. 18C shows examples of two different support structures for filament cathode segments.

(6) As described in parent application Ser. No. 657,867, coil springs (FIG. 18C) can reduce the cold terminal effect by shrinking the cold terminals into coils. However, coil springs are not very strong mechanically. For large EFD display devices, a filament (FIG. 18A) can consist of two short segments at two ends, supported by coil springs, and one or more longer filament segments in-between, supported by strong finger springs (FIG. 18B).

Figure 13A:
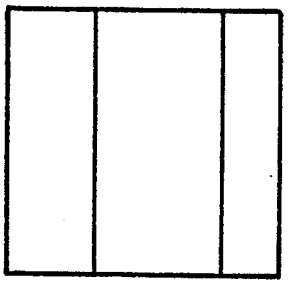
FIGS. 13A, 13B are schematic views of a pixel, showing two embodiments for varying the active areas of pixel dots.
Figure 13B:
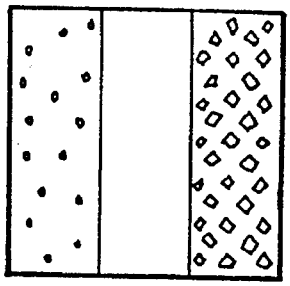

(7) The amount of phosphor efficiency change are functions of the total charges that have been projected onto the phosphors. See "Aging of Electronic Phosphors in Cathode-Ray Tubes," Pfahnl, A., *Advances in Electron Tube Technology,* Sept. 1960. By increasing the area while reducing the current density for faster aging phosphors, the color shift problem due to different rate of phosphor efficiency change can be improved. Life time of a phosphor is the time period for the brightness of the phosphor to be reduced by 50% when caused to emit light under the same operating conditions. For example, if the amounts of charge required for the efficiencies of phosphor A, B and C to reduce 50% are $Q_a$, $Q_b$ and $Q_c$, then the current density for these phosphors should be set at $J_a$, $J_b$ and $J_c$ where $J_a:J_b:J_c=Q_a:Q_b:Q_c$, by changing the waveforms or the duty factors of control electrodes. Then, under these current density ratio, the dot size of each phosphor can be adjusted to produce the desired color mix. This dot size adjustment can be done by changing outside dimensions of phosphor dots (FIG. 13A) or by leaving holes in phosphor dots of equal sizes (FIG. 13B) to change the effective emissive area.

Figure 14A:
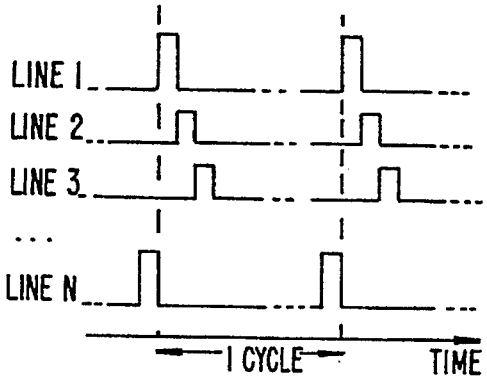
FIGS. 14A, 14B are graphical illustrations of two methods for applying voltage pulses to scanning grid electrodes to improve image quality such as uniformity.
Figure 14B:
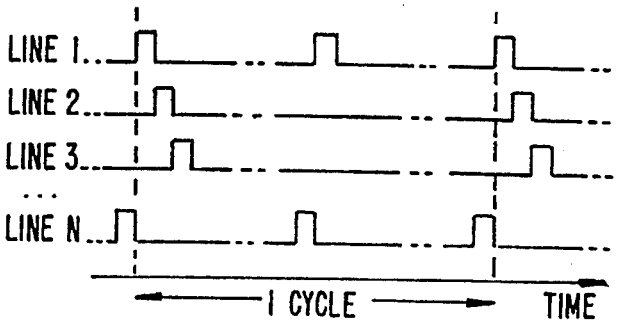

(8) The approach of modulating phosphor dot size and driving waveform just described can also be borrowed to compensate the brightness fluctuation caused by spacer charging, cold terminal or washboard effects. We can reduce the phosphor dot size under area where electron current density is high or increase the drive intensity of control electrodes where the electron current density is low. For example, when arrays of vertical filaments are used and no auxiliary filaments are employed, the brightness near the display tile's top and bottom will be significantly lower than the rest of the tile. This can be compensated by scanning the lines at the top and the bottom (line 1 and N in FIG. 14B) more frequently than the rest of the display, in other words, increase the percentage of time these lines are on. Or, we can compensate the difference by increasing control signal (voltage) amplitudes or pulse widths for the top and the bottom lines (line 1 and N in FIG. 14A) while leaving the percentage of time spent on each line equal. Both methods can be applied simultaneously.

It should be noted that although in the above discussions we assumed that cathodes are made of filament arrays. Many of the methods just discussed applies equally well to other kinds of cathodes. For example, if strips of field emitter arrays are used as the cathode, the cold terminal effect will not be a problem since the rate of electron emission no longer depends on the temperature of the cathode. All the other issues, however, stay the same and the methods described above will be useful.

CONTRAST AND IMAGE ENHANCEMENTS: The contrast of a display device is defined by the ratio between the maximum and the minimum brightness measured on its surface under the intended viewing environment. A high contrast display system can produce highly saturated color with vivid details of various shades. A low contrast display generally looks pale and can not reproduce detail images of dark shades. In order to enhance the contrast, conventional CRT TV systems employs methods such as black matrix, aluminum back coating on phosphors, dyed phosphors and gray face plates. On top of these methods, three new methods may be used to further improve its contrast.

Figure 15:
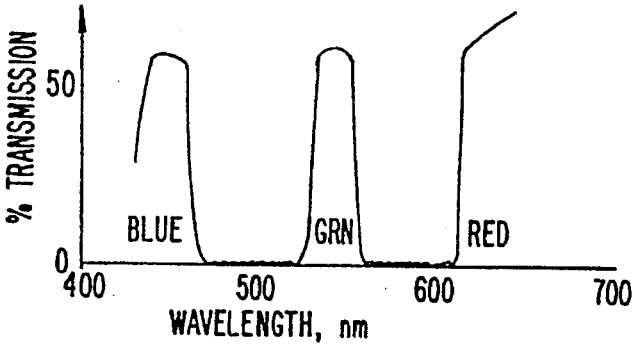
FIG. 15 shows the shape of transmission curve of a spectrum selective glass plate of an embodiment of the invention.

(1) The face plate of the device can be made of a spectrum selective glass such that the face plate will have high transmittance at wave lengths matching the emission peaks of phosphors used (FIG. 15). For example, the AC-36 or AC-55 contrast enhancement glass by HOYA Optics Inc. has transmittance of above 40% for the peaks of P-22 series color phosphors while allowing less than 2% of the rest of visible spectrum to pass through it.

(2) A color filter made of dots of red, green and blue transparent ink can be coated on the outside surface of the front face plate (FIGS. 8B, 8C, 16 and 12B). These dot patterns should match that of the phosphor patterns on the other side of the face plate with proper alignments. These color dots will absorb most of the lights of colors other than its own.

(3) The layer of color filter described in method 2 can also be layed between the anode and the front face plate. In this application, only pigments that are stable under high temperature EFD sealing environment should be used.

All three methods described above take advantage of the fact that ambient lights are of fairly wide band while phosphor emissions usually have narrow bands. This selective absorption will significantly reduce the reflections from the ambient lights while permitting majority of the lights emitted by phosphors to pass to maintain adequate brightness of the display.

Figure 16:
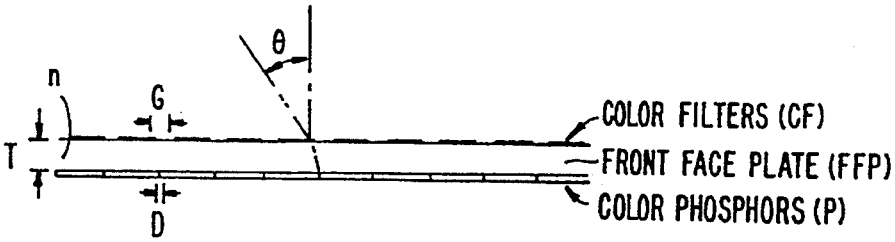
FIG. 16 shows the effect of the gaps between color filters, the alignment between color filters and the phosphor dots and the relationship between the color filter gap and the viewing angle.

One undesirable side effect will happen when the color filters of method 2 are used. Because the color filters and phosphors are coated on the opposite sides of the front face plate, they are only aligned with each other when viewed from the normal direction. If viewed at an angle, phosphors and filters of different colors may overlap. Since the color filter is designed to have high absorption coefficients for all colors but its own, this overlap will cause the observed brightness to decrease as the viewing angle θ is increased (FIG. 16). This problem can be avoided by leaving gaps between filters of different colors. The gap size is a function of the face plate thickness and the desired viewing angle. For a given viewing angle, the thicker the face plate, the wider the gap, and the less effective the filter. This technique will be most useful when the face plate can be made very thin, as will be the case for many devices based on EFD technologies.

Another major feature of EFD is the use of net-shaped spacer plates. This feature allows EFD to attain large area display devices with very rigid but light weight structures. However, the footprint of these spacers take up spaces on the front face plate. In addition, due to the spacer charging effect, cathode electrons cannot reach areas very close to spacer surfaces. Collectively, those area rendered non-emissive because of the two reasons just mentioned will be referred to as spacer shadows. These shadowed areas can be covered by strips of black glass frit (black matrix mask or BMM in FIGS. 8B, 17A–17C) to enhance contrast and to reduce the waste of anode power. These black matrix masks will leave visible black lines when images are displayed. These lines can be minimized with the help of a compensation lens (Fresnel lens in FIG. 17C) attached to the front of the face plate (CL in FIG. 17A). The combined optical properties of the lens and the front face plate will reduce the width of those black strips as perceived by the viewer. In the mosaic embodiment of EFD, this feature become quite important, since here the inter tile gaps (ITG in FIG. 17A), rather than the thickness of spacer walls, become the determining factor for black strip width. These gaps, in general, are significantly larger than the thickness of spacer walls.

The last aspect of this invention relates to the red, green, blue (R, G, B) phosphor dot patterns in a color EFD device. As is widely recognized that human eyes are particularly sensitive to the green. In fact, the perception of brightness for a white light can be roughly divided into 60% from green, 30% from red and 10% from blue. Since human visual system has a much higher resolution for the change of luminance (or brightness), than for chrominance (or color), a RGBG pattern (FIG. 19B) will be superior to a RGB pattern (FIG. 19A) for the following reasons.

(1) Given the same number of phosphor dots, repeating RGBG pattern will have 50% more green dots than that of repeating RGB pattern. Mathematically speaking, in a RGBG pattern, 50% of the dots will be G, compared to the 33.3% green dots in RGB pattern, the ratio of green dots will then be: 0.5/0.333=1.5. Since green carries the majority of the brightness information, a RGBR pattern will be perceived as having higher resolution than a RGB pattern because human visual systems have higher resolution for brightness than for color.

(2) The RGBG pattern always have one red dot and one blue dot surrounding every green dot (FIG. 19B), this means RGB triplets are formed locally around every green dots which allows smooth color mixing to be perceived by human eyes.

Figure 19A:
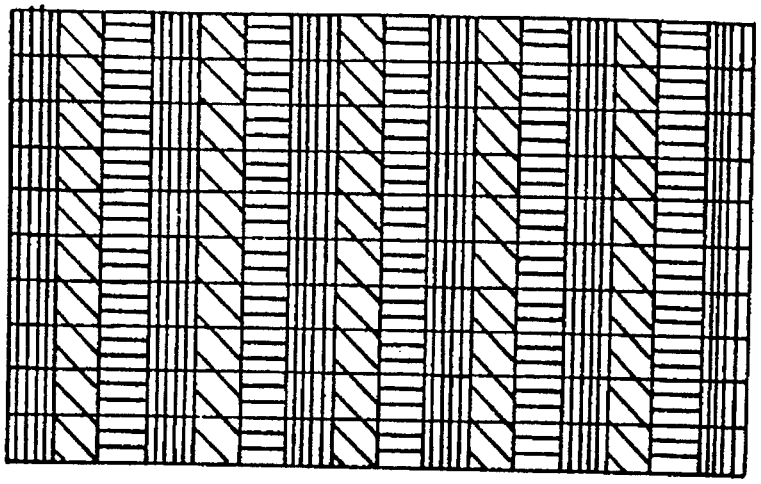
FIG. 19A–19C are schematic views of three different pixel dot patterns to illustrate the invention for achieving a highly uniform color display.
Figure 19B:
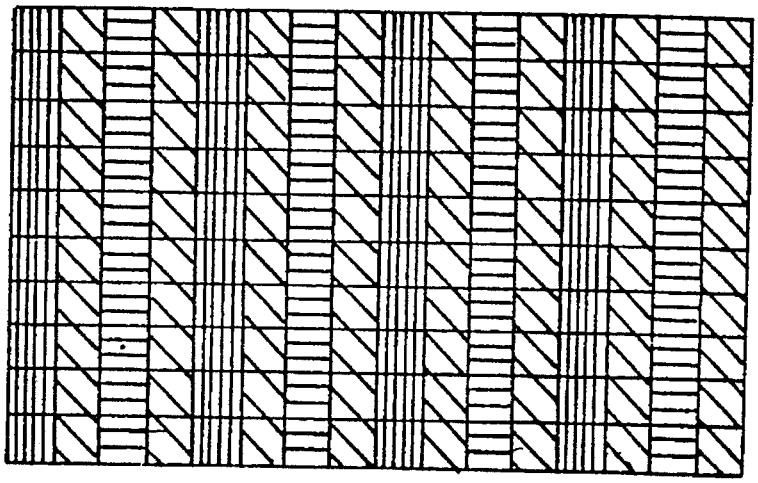
Figure 19C:
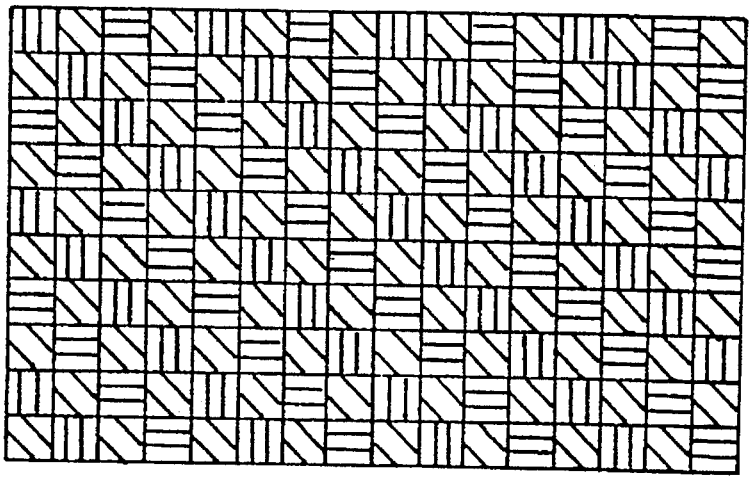

(3) This RGBG pattern can also be repeated in a two dimensional fashion (FIG. 19C). This arrangement will achieve the local RGB triplet formation in both vertical and horizontal direction. In addition to enhancing the smoothness of the image significantly, the green dots of this two dimensional RGBG arrangement will form a chess board pattern as opposed to vertical or horizontal lines which are known to produce inferior image quality due to the tendency to interfere with scenes and produce distortions when images contain lots of straight lines.

The dot pattern of FIGS. 19A–19C may also be generalized in the following manner. In reference to FIGS. 19A, 19B, the red (R), green (G) and blue (B) phosphor dots form vertical columns, in a repetitive RGB pattern in FIG. 19A and in a RGBG repetitive pattern in FIG. 19B. In FIG. 19C, instead of forming vertical columns, the red, green and blue phosphor dots form inclined arrays of the same color in a RGBG repetitive pattern.

High Resolution EFD Mosaic Tile

Referring to drawings FIGS. 8A to 19C, an embodiment of a pentode mosaic EFD tile is described. The like reference designate like or corresponding parts through out this portion of discussion of this embodiment.

The demonstrated EFD mosaic tile consists of a vacuum chamber made of a front face plate FFP, a back face plate BFP and four side walls SW. The front face plate FFP can be made of spectrum selective glass with a transmission curve generally similar to the curve shown in FIG. 15. The peaks of the transmission curve should match the peaks of the phosphors employed in the device.

Preferably, the infrared side of the transmission curve should be high such that heat is not trapped inside the device. The valleys of this transmission curve will have very low transmissions in order to fully absorb ambient light. The peaks of the transmission curve allow the lights generated by the phosphors to pass through without excessive attenuation. In addition, since the ambient light will pass through FFP twice, once going from outside through FFP to the phosphor layer, once back from phosphor layer to the viewer, the attenuation of ambient light is the square of the transmissions of the FFP. The effect of this face plate glass is to significantly enhance the contrast of the device under well lit view environment. A layer of color filter CF made of transparent ink or other material can be coated on the outside surface of the FFP to further enhance the contrast. The theory of operation for this layer of color filter is similar to the spectrum selective glass used for the FFP. The difference is that each color filter will have only one peak in its transmission curve. But since filters of different colors are placed in front of phosphors emitting different lights, by matching the color of the filter and the light emitted by the phosphor, this layer of color filters can significantly enhance the contrast of the device.

On the inside surface of the FFP, a layer of transparent conductive material, such as $SnO_2$ or ITO, is coated as the anode (A). A layer of color phosphor dots (P), emitting red, green and blue light, with pattern similar to FIG. 19C is further coated on top of A. A layer of black matrix mask BMM made of material such as black glass frit is coated on top of anode A, in the same plane as the phosphor layer. A pattern of silver paste trace SPT is printed on top of the anode (A) under the black matrix mask BMM. This pattern should cover the front face plate FFP alignment holes AH to provide low resistance paths for anode over a large area. The pattern of the color filter CF and the pattern of phosphor dots should be matched and aligned with each other. Furthermore, gaps are left blank between filter dots of different color. The gap width G (FIG. 16) is related to the thickness T and the index of refraction n of FFP, the gap D between neighboring phosphor dots, the desired viewing angle θ and the accumulated alignment error ϵ by:

$$G \cong \epsilon + 2T \times \tan(\sin^{-1}(\sin\theta/n)) - D$$

Figure 12A:
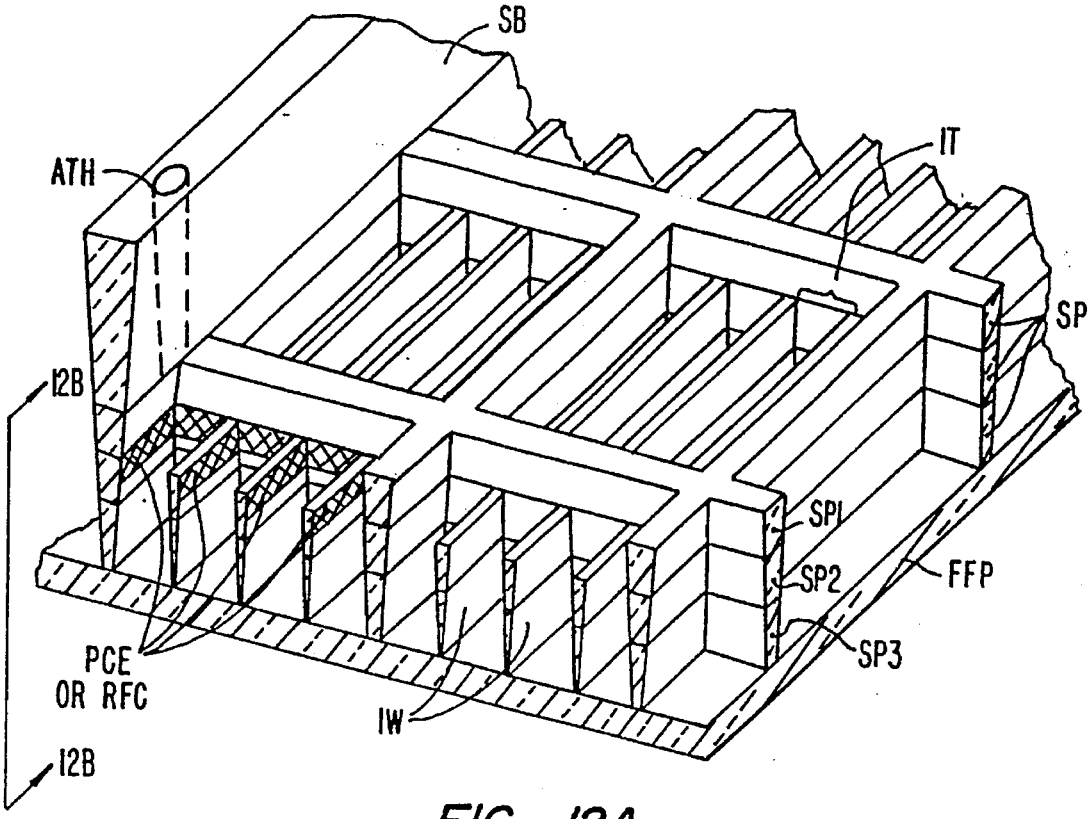
FIG. 12A is a cut away view of spacer structures and their relationship to the front face plate.
Figure 12B:
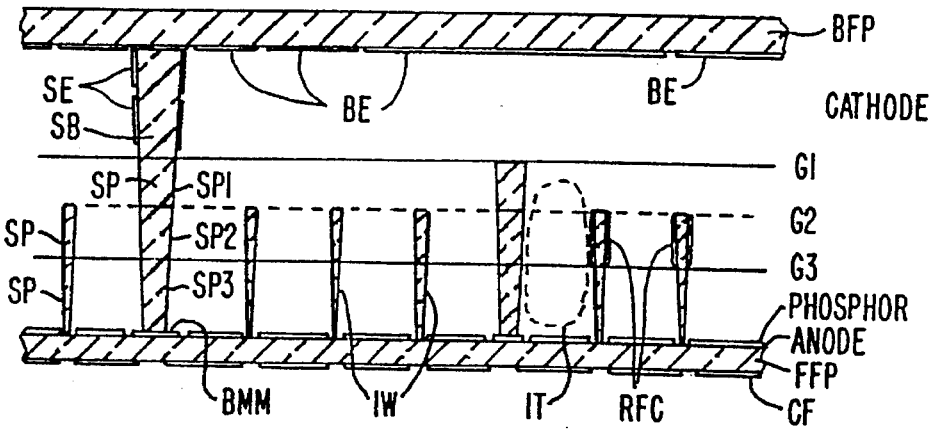
FIG. 12B shows details of control electrodes and the isolation walls from perspective L of FIG. 12A.

From the formula given above, one can see that the thickness of the front face plate should be minimized in order for the color filter to be effective. On top of FFP, toward BFP, three layers of spacer plates (SP) SP1 through SP3 are stacked on top of each other. These spacer plates have their openings designed in such a way that when stacked together, their walls form smooth tapering surfaces with pointed sides facing, and pressed against, the anode. The spacer plates SP2 and SP3 have many thin isolation walls IW. When SP3 and SP2 are stacked together, the combined structure form many isolation tunnels IT between these isolation walls IW (FIGS. 12A and 12B). Each of these isolation tunnels IT matches the outline of a pair of phosphor dots. One important function of these tunnels is to physically confine the trajectories of electrons directed toward the anode and therefore eliminate most of the crosstalks. The two phosphor dots within one tunnel are from different scan lines but are of same color in order to minimize the loss of color saturation due to minor crosstalk. The wall surfaces of SP2, and possibly part of SP1 and SP3 surfaces, are further coated with a layer of resistive material to control the build up of static charges. Due to the fine pitch walls of spacer plates SP3 through SP1, and due to the technique that these spacer plates SP1 through SP3 and FFP are firmly glued into one solid structure with material such as glass frit or appropriate glues, as shown in FIG. 12A, the combined structure will be far stronger than the thickness of FFP alone would suggest and, thus, allow very thin glass plate to be used for FFP. Depends on the pitch of the supporting walls of SP3, SP2 and SP1, front face plate FFP can be made of glass plates less than 1 mm in thickness and still have enough strength to withstand the atmospheric pressure.

Figure 20:
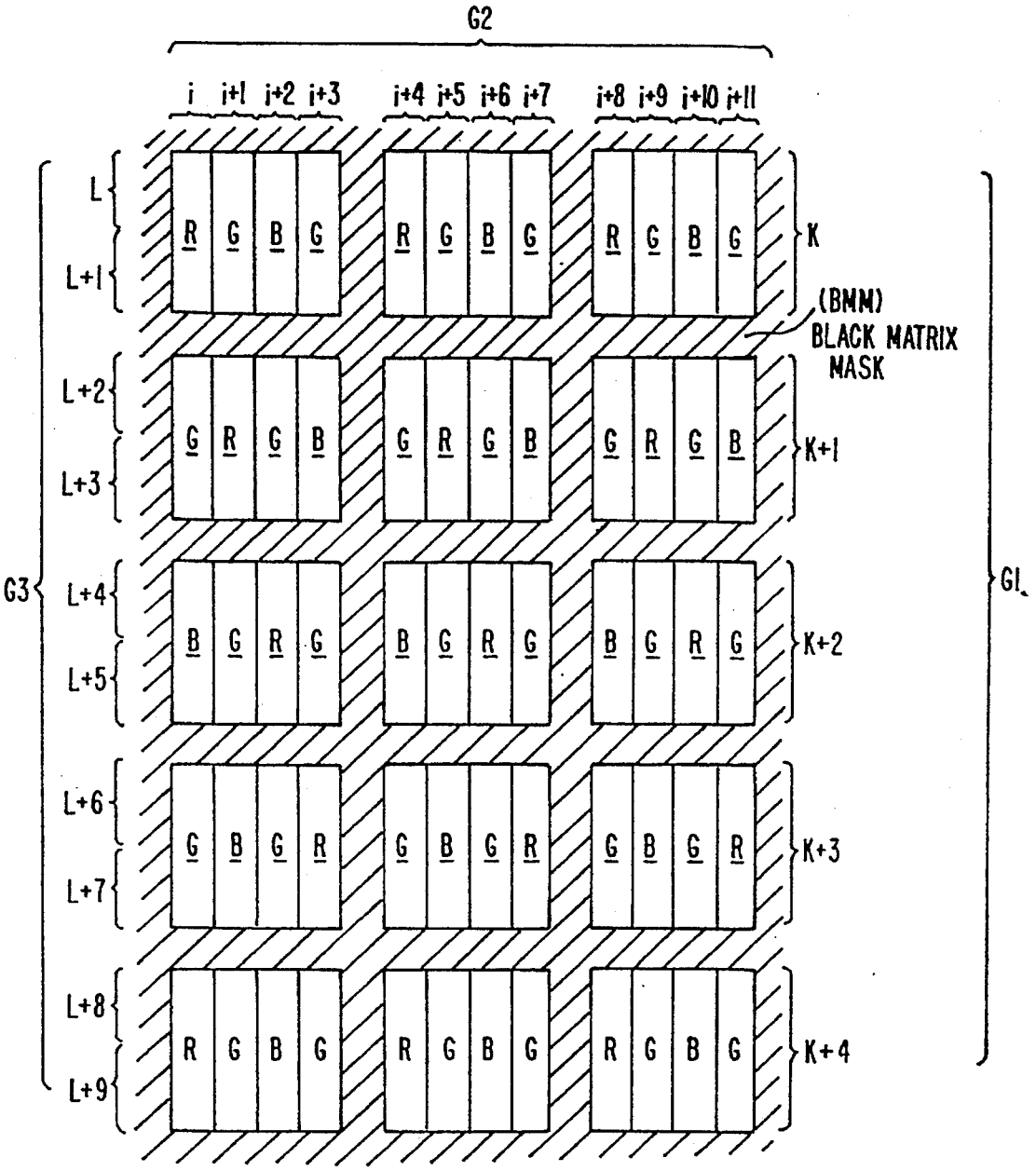
FIG. 20 is a schematic view of an array of 15 pixels each with 4 pixel dots (RGBG), addressed by 10 grid electrodes G3 running in the horizontal direction and 12 grid electrodes G2 running in the vertical direction.

The control grid electrodes are made of three layers of fine metal wires of diameter around 1 mil with a center to center pitch of about 0.1 to 0.5 mm (FIGS. 11A, 11B). These wires are grouped to form electrodes in each layer. The layer G3 is sandwiched between the two spacer plates having fine isolation walls (SP2, SP3). The layer G2 is sandwiched between spacer plates SP2 and SP1. The layer G1 is placed on top of SP1 facing the cathode. All three layers of electrodes are glued to the spacer plates to minimize vibration, sagging, etc.. The electrodes of both G1 and G3 are oriented horizontally. Two G3 electrodes and one G1 electrodes cover each row of isolation tunnels IT at two different cross sections of the tunnels. G1 and G3 are operated in synchronization to perform line by line scanning operation. G2 electrodes are oriented vertically and each G2 electrode covers one column of isolation tunnels IT. The overlapping area between each distinct pair of G2 electrode and G3 electrode defines a pixel. Under each pixel, a phosphor dot is defined on the anode surface. Two pixels share one isolation tunnel IT. An overlapped view from the front/viewing direction is shown in FIG. 20.

By controlling the diameter and the pitch of wires in each electrode and the distances between anode, G3, G2, G1 and cathode, G1 electrode can be made to have a saturation voltage $V_{on1}$ in the range around 20 V to 80 V and cut-off voltage $V_{off1}$ in the range around 0 V to −20 V; G2 electrode have saturation voltage $V_{on2}$ in the range around 10 V to 40 V and cut-off voltage $V_{off2}$ in the range around 5 V to −10 V; G3 electrode have saturation voltage $V_{on3}$ in the range around 10 V to 30 V and cut-off voltage $V_{off3}$ in the range around −10 V to −60 V, all assuming that the cathode is at ground level or 0 V. When line N is scanned, electrode $G3_N$ and electrode $G1_{N/2}$ will have voltage $V_{on3}$ and $V_{on1}$ respectively, and the intensity of each pixel in that line is controlled by the voltage applied to the corresponding G2 electrode. As shown in FIG. 11B, G3 can be utilized to reduce cross talk between neighboring scanning lines. By properly selecting the off voltage for G3, electrons are focused onto pixels that are being scanned and pushed away from the pixels that are not being scanned, such as by applying a negative voltage as the off voltage with cathode at ground.

Between the spacer plate SP1 and the back face plate BFP is a layer of spacer bars SB and reinforcement bars RB. As shown in FIG. 12B, side electrodes SE and back electrodes BE are placed on the surfaces of spacer/reinforcement bars and the back face plate respectively. When voltages are applied to these electrodes, electric field is created to spread out electrons generated by the filament cathode and to counter the electric fields created by static charges on the surface of spacer walls. Electrodes SE and BE may contain high secondary electron emission materials such as caesium oxide compounds. When properly energized these electrodes can also serve as secondary electron generation centers. The combined effect of the electric field and the extra electrons generated by secondary electron emission effect creates a smooth electron cloud.

On the front face plate FFP, back face plate, BFP, spacer plates SP1 to SP3 and spacer bars SB, alignment holes (AH) and alignment through holes (ATH) are created such that alignment pins AP can be inserted into these holes and through holes to align all parts with respect to one another. Some alignment pins AP may be glass tubes with metal pins as the core. The metal pin extrudes beyond two ends of AP. At one end, the metal pin is connected to the anode A through the silver paste printed on the anode A. At the other end, the metal pin of AP is connected to the PCB attached to the back of the back face plate BFP to provide connections to the anode from PCB at back of BFP. In this structure, both the glass tubing of AP and the wall of the alignment through holes ATH serve as the insulation to isolate anode connection from control electrodes and cathode filaments. The combined wall thickness should be thick enough to withstand the anode voltage, which is usually around 500 V to 5,000 V. For the Fotoform glass of Corning, the dielectric strength is rated at about 4,000 V/mil, therefore the combined insulation thickness should be about 1.6 mil or 0.04 mm. The silver paste traces SPT printed on the anode generally occupy spaces under the footprint of the spacer plate SP3. These silver paste traces SPT provides low resistance anode connection throughout the entire anode to avoid heat concentration problem which is otherwise experienced near the contact points between anode coating and the metal connectors.

The side walls (SW) are made of thin glass material of around 0.2 mm to 1 mm in thickness. The inside surface may be printed with conductive wiring traces WT to connect electrodes of G1, G2 and G3 to the PCB. Other wiring traces may also be printed to connect to other internal electrodes, such as the side electrode SE, placed on the surface of spacer/reinforcement bars, and back electrodes BE, placed on the back face plate BFP. Connection between control electrodes and the wiring traces WT printed on the side wall are made by mechanical contact through spring action. Conductive paste such as silver paste may be added to enhance the conductivity of the contact points.

The side walls are sealed to the front face plate with their narrow side edges by sealing glass frit at a temperature around 430 degrees Centigrade. These side walls SW are supported from inside by layers of spacer plates SP1 to SP3, reinforcement bars RB and spacer bars SB. The spacer plate SP3 does not have walls or side bars as do SP1 and SP2 along the edges where such side bars make contact with the side walls SW along the entire lengths of the side bars. But the fine pitch walls of SP3 can be spaced less than 10 mm away from each other with their edges attached to side wall SW to provide enough support to the side wall SW to allow thin glass plates to be used as side walls SW. The main purpose of leaving off the walls along the edge of SP3 is to minimize the inter tile gap ITG (FIG. 17A) when many tiles are put together to form a complete display systems. Both spacer plates SP1 and SP2 have walls where they made contact with side walls SW. These walls form chisel shaped structures with the pointed side facing the anode. In addition to provide extra support to the side walls, these walls also provide the needed pressure to ensure that the wiring traces printed on the side wall and the control electrodes are in good contact. In addition, the tapered surface of these walls reduce the disturbance of the electron flux flowing from the cathode to the anode, and therefore minimize the shadow along the sides of a tile. To further reduce the visual impact of the inter tile gaps ITG and the footprint of spacers, a compensation lens CL is attached to the front face plate FFP as shown in FIGS. 8B, 8C and FIGS. 17A–17C. FIG. 17B is a closed up view of the compensation lens. FIG. 17C is an alternative implementation of CL in the form of a Fresnel lens. This lens surface curvature is designed to optically shrink the width of the ITG and the black matrix mask BMM. This lens can be made of optically transparent material such as glass, organic glass, acrylic or plastic. The curved portion of the surface should be optically clear. The portion of surface that is flat can be made grainy to diffuse reflections of ambient lights. An alternative approach is to process the entire surface with antireflection coating. Instead of employing a separate lens, the front face plate FFP may be made in a shape with the above described lens characteristics.

All four side walls are tilted inward by about 5 degrees, from FFP to BFP. The tilting creates tiny gaps between tiles. These gaps allow the front face plate FFP of neighboring tiles to be tightly packed together without producing too much stress on the side walls SW. A layer of buffering material BL can be added to the outside surface of side wall SW. Together with the gap created by the tilt, this buffering layer BL protects side walls SW from mechanical friction between neighboring tiles and the scratches of dust particles.

Inside the side walls SW, between the spacer plate SP1 and the back face plate BFP, are reinforcement bars RB. These reinforcement bars are glued to the inside surface of the side wall SW by material such as glass frit. In effect, the thickness of the side wall between SP1 and BFP are increased to the combined thickness of SW and RB. The reinforcement bars RB further have alignment slots AS on their surfaces. The positions of these alignment slots AS are matched with those of walls in spacer plates SP1. Together with the alignment through holes ATH in the spacer bars, these alignment slots AS will allow the position of SB to match exactly to the walls of spacer plates SP1 to SP3, and therefore attain high resolution alignment between parts. An alternative to this configuration is to have a one piece structure etched into the shape of the assembled reinforcement bar RB, spacer bars SB structure. This alternative, although very precise, requires etching of relatively thick photo sensitive glass of about 1.5 mm to 5 mm which can be quite wasteful. In addition, the side electrode SE forming process will become more complicated in the one piece structure.

Figure 18C:
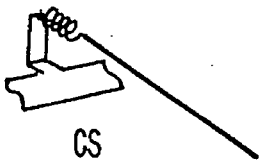

In the space between the spacer plate SP1 and the back face plate BFP lie the cathode comprising a filament array. A possible filament array arrangement is shown in FIGS. 18A through 18C, where each filament has three segments: two short ones, supported by coil spring (CS), at the two ends, and a long one, supported by finger springs, at the center. To cover up the cold terminals created by temperature drops due to energy lost to the support by thermal conduction, these three filament segments overlap one another such that one filament's cold terminal will be covered by the other's normal working portion. Furthermore, two auxiliary filaments AF are added the top and bottom sides of the array to cover the cold terminals of the spring terminals at the ends of each filament. More generally, the array has substantially parallel filaments each having ends at end locations. Auxiliary filaments are added at or near the end locations to reduce cold terminal effects. Examples of finger spring and coil spring are given in FIG. 18B and FIG. 18C respectively. Together with the side electrodes SE and the back electrodes BE, this filament cathode structure will provide a fairly uniform electron cloud behind control electrodes G1, G2 and G3. The filaments can be connected to the PCB through filament connection pins FCP (FIG. 8C) which are made of glass tubes with metal pins as their cores. These pins FCP are then placed through, and sealed to, holes drilled or etched on the back face plate BFP.

Figure 21A:
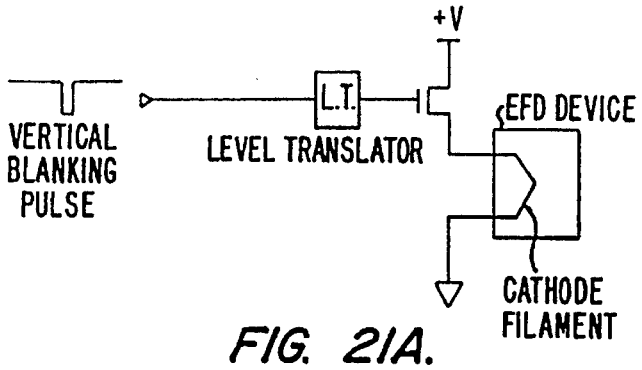
FIGS. 21A, 21B are views of circuits for applying rated signals to the electrodes of the display to illustrate the invention.
Figure 21B:
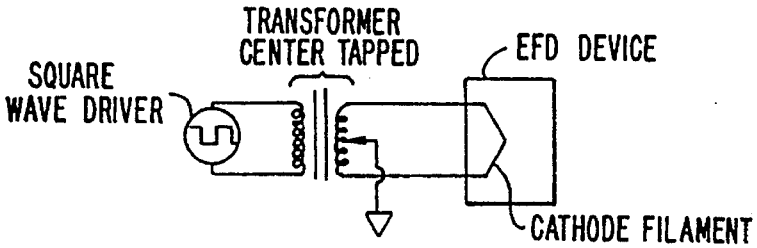

Under a preferred operation condition, the filaments are heated by applying a rated voltage at their ends. The heat thus generated raise the temperature of filaments high enough such that free electrons are generated through thermion emission reaction. The rated filament heating voltage is applied in a pulsed fashion as illustrated in FIG. 21A, such that during the gaps between line scanning operations, such as the vertical blanking period, pulses of energies are fed to the filaments to maintain their temperature. The heating voltage can also be applied in a continuous fashion as shown in FIG. 21B, where a center tapped, and grounded, transformer is employed to convert an AC square wave form into balanced voltages to be applied to the ends of filaments.

The electrons generated by the cathode are further smoothed by various electrodes placed on the back (BE) and the side (SE) of filament cathodes. These rather uniform electron clouds are then attracted or expelled by the voltage applied to G1 electrodes. When the voltage applied to G1 is significantly positive relative to the cathode, the electrons will be accelerated toward G1.

Since G1 is made of very fine metal wires, most of the accelerated electrons will miss those wires and enter the space between G1 and G2. In this space, the voltage applied to G2 determines whether these electrons, which have just missed G1, will be pushed back to G1 or pulled through to the space between G2 and G3. Similar condition repeats in the space between G2 and G3. Electrons passing through all three layers of control electrodes are then accelerated toward the anode and impact the phosphors coated on top of the anode at speeds determined by the applied anode voltage.

In this operation, G1 is responsible for most of the initial acceleration of electrons. When electrons pass through G1, they are moving in directions largely perpendicular to G1, and therefore, to the anode. This general direction of movement is kept throughout G2, G3 until reaching the anode and form the essence of focusing effect for EFD control electrodes. An important factor of EFD matrix addressing resolution is the distance between anode and the control electrodes. Due to the low anode voltage used in EFD, as compared to conventional color CRT television sets, and the omission of electron beam formation and deflection apparatus, the distance between anode and control electrodes can be made very short. This short distance significantly reduces the distance of lateral electron movement and the chance of scattering, and therefore improves the addressing resolutions of the device.

The addition of thin isolation walls IW to the spacer plates further improves the focusing ability of EFD by physically isolating pixels from pixels. In the current embodiment, since both SP2 and SP3 employ thin isolation walls, the resolution will essentially be determined by the precision of these spacer plates.

When both G1 and G2 are positively energized, and all G3 electrodes are at the cut off voltage, the electrons attracted by G1 will be bounced around these electrodes and eventually be absorbed by G1. However, if one of the G3 electrodes under the G1 electrode is turned on, then a large portion of the bouncing electrons will find way through the turned on G3 electrode and increase the anode current density thereof. In other words, one of the ways to increase the brightness is to have G1 electrodes cover an area that is larger than the area actually scanned by G3.

Figure 22:
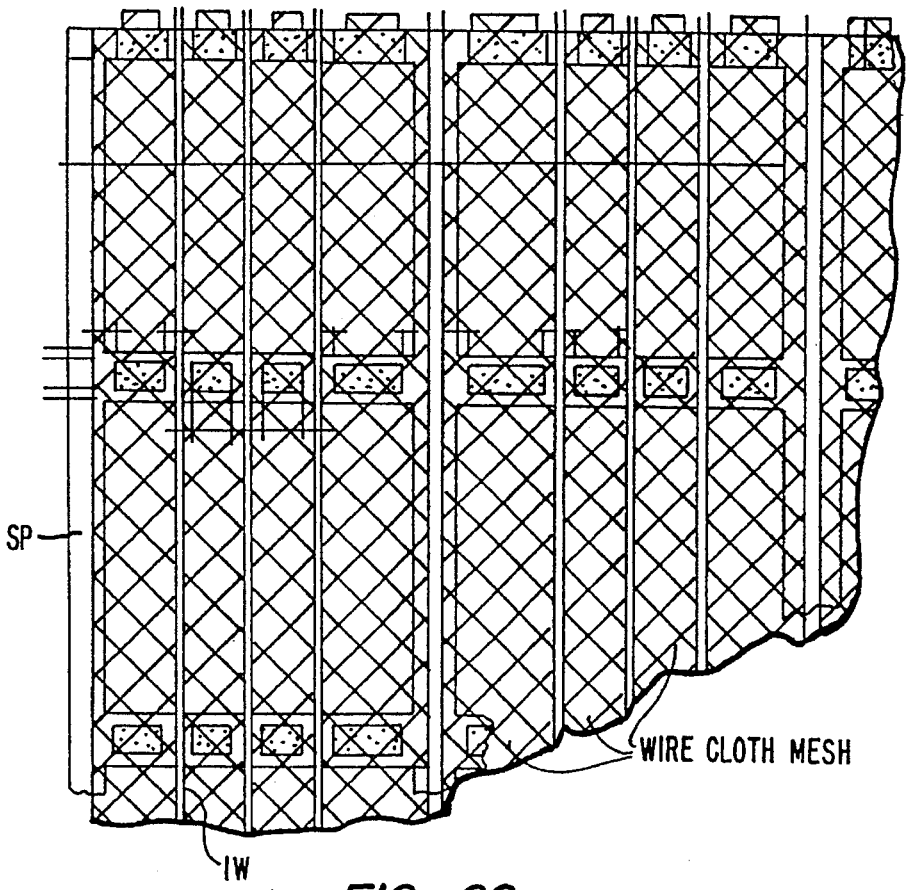
FIG. 22 is a schematic view of a portion of the display device of the invention to illustrate the construction of the grid electrodes of this invention.

Since only those electrons whose trajectories pass through the cores of the electrode wires will have a chance to be absorbed by the electrode, the osmotic coefficient, or the ratio between electrons arriving at the anode and the electrons emitted by the cathode, of EFD made with fine wire control electrodes can be higher than 95% with proper selection of wires diameters and pitches. If the ratio between blocking area and open area can be controlled properly, similar effect can be achieved by electrodes made of metal wire clothes or net shaped foil formed through perforation or etching. When wire cloth or net shaped foil electrodes are used, the electrode can have their pattern oriented at 45 degrees to the side wall (FIG. 22). This will help avoid deformations caused thermal expansion coefficient mismatch between the electrode material and the rest of the EFD assembly.

When the electrodes are made of etched or perforated metal foils, such as a sheet of 1.5 mil thick 426 alloy, a different approach can betaken to connect these electrodes to the PCB. FIG. 24A is a top view of a planar electrode frame before the electrode array is cut from the frame and formed into the shape shown in FIG. 24B. By leaving long finger on one side of each electrode as shown in FIG. 24A, the connection to PCB can be made by simply connecting these fingers to the PCB, as illustrated in FIGS. 24B and FIG. 24C. FIGS. 24D, 24E are exploded views of the portions of FIG. 24A within circles. In this approach the side walls SW do not need to have wiring traces WT printed on their surfaces and the side walls SW are not required to extend beyond the back face plate BFP. The omission of contact points on the surface of the side wall also allows more liberal application of bonding material such as glass frit without worrying about getting in the way of the wiring contacts.

The openings in the finger of each electrode allow maximum bounding strength between various components of the side wall structure. Also to be noted in the pattern of the foil are the tiny links between neighboring electrodes. These tiny links allow the electrodes to maintain their proper positions during the assembly process. These links can later be removed by methods such as laser cutting.

Improved Anode Connection

In the original EFD mosaic design, as shown in FIG. 23A, the anode connection is made through the outgassing hole 707 located at the center on the back of the tile. The connection scheme works fine for anode voltages below 1.5 KV. As the anode voltage rises, however, electrons emitted by filament 413 start to fly directly through 707 to anode connection 405. This short cut passage between cathode and the anode electrode is responsible for the breakdown voltage restriction of the original EFD structure. An improved anode connection is shown in FIGS. 23B, 23C, where an isolation bench 499, with an optional electrode plate 497 which is connected to 413, is placed on top of the outgassing hole 407. By properly controlling the diameter of the hole 707, the height, width and length of the isolation bench 499, the passage between 413 and 405 can be effectively blocked off and the safe operating anode voltage of EFD devices can be raised significantly.

With the use of alignment pins AP as shown in FIG. 8B, 10 yet another anode connection scheme is possible. In this method, the anode connection is made through the metal connectors in the center of alignment pins and the alignment pins are sealed to the glass assembly. Because they are enclosed in highly insulating material all the way, these connectors, and therefore EFD devices made with this type anode connection scheme, can operate at high anode voltage of over 5,000 volts with good stability.

Single Piece High Resolution EFD

Referring to drawing FIG. 25A to FIG. 28, another embodiment of a pentode single piece EFD screen is described. The like reference designates like or corresponding parts throughout this portion of discussion. Many parts are structurally and functionally similar to those described in the embodiment described immediately above. These parts will be designated by like names and their explanation will only cover the differences or the portion that may cause confusion.

The demonstrated EFD single piece screen consists of a vacuum chamber made of a front face plate FFP, a back face plate BFP, three layers of spacer plate SP1, SP2 and SP3, a layer of spacer bars SB and edge spacer bars ESB.

The front face plate FFP can be made of spectrum selective glass with a transmission curve similar to the one shown in FIG. 17. The peaks of the transmission curve of FFP glass should match the emission peaks of the phosphors used in the device.

On the inside surface of FFP, a layer of transparent conductive material (not shown in FIGS. 25A, 25C), such as $SnO_2$ or ITO, is coated as the anode A. A layer of color phosphor dots (P) emitting red, green and blue lights is coated on top of the anode. The pattern of the phosphor dots is a two dimensional repeating RGBG as shown in FIG. 19C. In addition, a layer of black matrix mask BMM made of material such as black glass frit is also coated on top of the anode, in the same plane as the layer of phosphor dots. Under the layer of black matrix mask BMM and on top of the transparent conductor, a pattern of silver paste trace is printed to reduce the surface resistivity of the anode. The pattern of the silver paste trace further pass through the alignment holes AH in the FFP. These holes are used both for alignment purpose and for the connection to the anode.

Three layers of spacer plates SP1, SP2 and SP3 are stacked on top of the FFP where SP3 is in direct contact with the anode, SP2 is on top of SP3 and SP1 is on top of SP2. Depends on the size of the screen, each layer of the spacer plate can be made of multiple pieces of smaller spacer plates. These smaller plates are assembled together with alignment features employed in this embodiment. One technology that is capable of making the spacer plates with the required precision is the Fotoform glass of Corning. The largest plates which can be readily produced by Fotoform glass are around 16 inches by 20 inches. Larger plates are possible but have not been attempted. The ability of precisely putting together smaller pieces of spacer plates to function as a larger spacer plate is crucial to the making of screens larger than 30 inch in diagonal.

On top of SP1 is an array of spacer bars SB. Along the four edges of the screen are the edge spacer bars ESB forming a side wall. On top of these spacer bars are the back face plate BFP to complete the vacuum chamber.

Cathodes made of filament arrays are placed in the space between SP1 and BFP. The filaments are oriented vertically, running perpendicular to the orientation of G1 electrodes. Side electrodes SE and back electrodes BE are placed on the side and to the back of the filaments, as shown in FIG. 12B, to improve the uniformity of the display. Each filament may consist of multiple short segments supported by finger springs at both ends. These segments have their ends overlapped to reduce the cold terminal effect. No auxiliary filaments are used, but filaments are extended slightly beyond the top and bottom edges of the anode to avoid cold terminals at these area. In a TV or monitor application, the filaments can be heated in a pulsed fashion by feeding pulses of rated voltage to the filaments during the vertical blanking period.

Three layers of control electrodes G1, G2, G3 are layered between the three spacer plates SP1, SP2 and SP3 as shown in FIG. 12B. G1 is laid on top of SP1 under spacer bars SB. G2 is laid between SP1 and SP2. G3 is laid between SP3 and SP2. Control electrodes in G1 and G3 are oriented horizontally. They are operated in synchronization to perform line scanning operation. Each G1 and G3 grid electrodes are made of two or more fine metal wires of about 1 mil in diameter running parallel to one another at a center to center pitch around 0.1 mm to 0.5 mm. Control electrodes G2 are oriented vertically. This set of electrodes are responsible for the modulation of the intensity for phosphor dots in the line being scanned. G2 electrodes can be made of fine metal wires as G1 and G3 or it can be made of electrodes plated on the walls of spacer plate SP2. When G2 are not made of plated electrodes, the wall surfaces of spacer plate SP2, and possibly a portion of the wall surfaces of SP1 and SP3, are coated with a layer RFC of resistive material shown in FIG. 12B. This layer of resistive material provides a drainage for static charges which would otherwise build up an electric field that may produce undesirable effects. When G2 are made of plated electrodes, the display can have two lines being scanned at any time. This is achieved by partitioning each vertical G2 electrode such as g2 into a top half g2' and a bottom half g2". Each half is connected from one side of the display and, for each column, two different data signal can be send in simultaneously. Under this connection scheme, the brightness of the display will be significantly increased, since the percentage time each line is scanned is doubled as compared to the one line at a time scanning method. This is accomplished by simultaneously applying independent data to G2' and G2" and scanning G2', G2" simultaneously using G1.

Figure 25A:
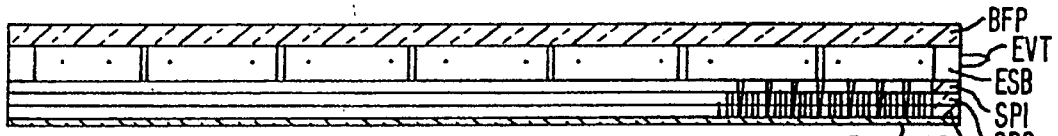
FIGS. 25A–25C are views of the device from several perspectives. Control electrodes are omitted in most parts of FIGS. 25A–25C for the sake of clarity.
Figure 25B:
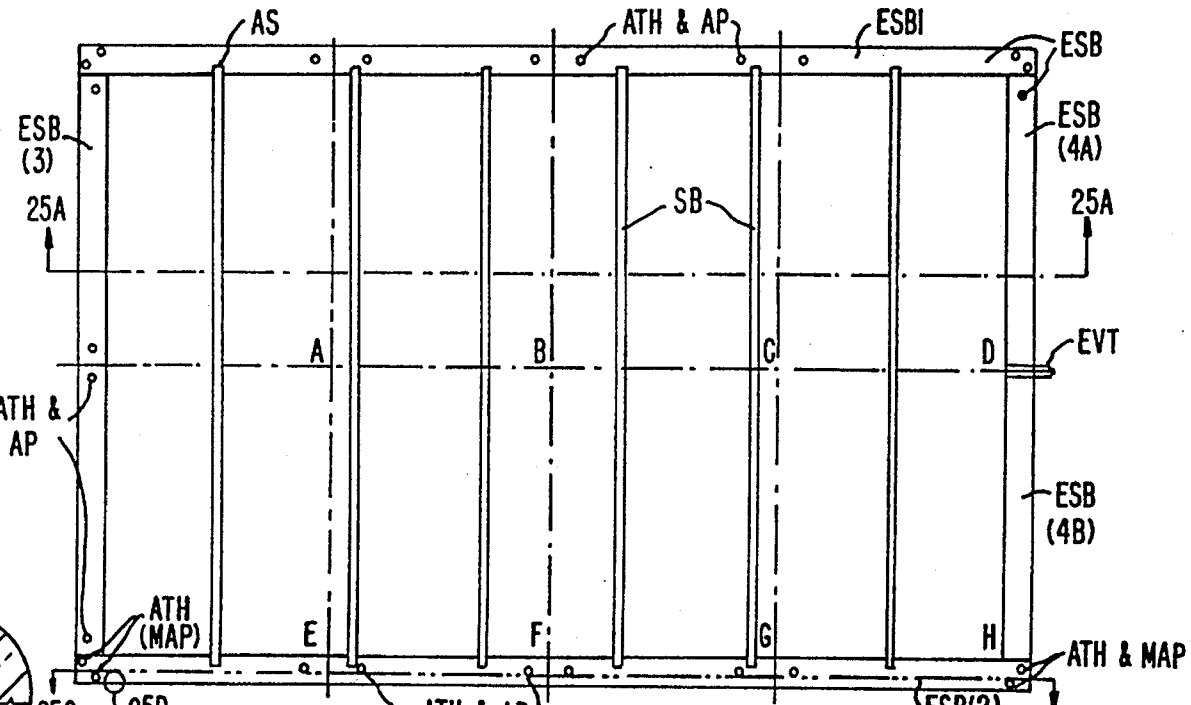
Figure 25C:
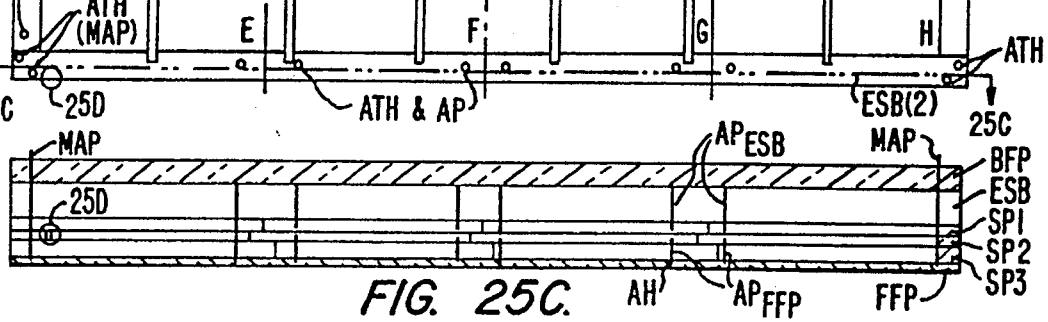
Figure 25D:
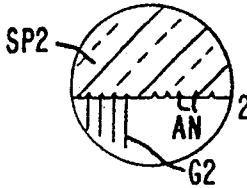
FIG. 25D is an enlarged view of a portion of the device of FIG. 25C.

The edge spacer bars ESB contain alignment slots AS and alignment through holes ATH. As shown in FIG. 25B, the alignment slots AS are used for aligning spacer bars SB with the walls in spacer plates SP1 through SP3. The alignment holes are used to align ESB with spacer plates SP1 through SP3. Preferably ESB1, ESB2 and ESB3 are made of one piece glass for both mechanical strength and assembly precision considerations. The position of the AS and ATH can then be used as reference for spacer bars SB and spacer plates SP1 through SP3 respectively. An evacuation tube EVT is placed between ESB4*a* and ESB4*b*. After the chamber has been properly evacuated, EVT will be sealed off to maintain the vacuum. The spacer plate layers SP3 and SP2 contain thin isolation walls whose function have been described in the summary and in the first embodiment. Along the four corners of the screen within the width of the edge spacer bars ESB, special alignment pins MAP made of glass tubes with metal pin in the center are employed. In addition to the alignment functions, these pins connect the anode to the PCB which is attached to the back of the back face plate BFP. Combined with the silver paste trace printed on top of the anode, these special alignment pin MAP will provide a low resistance anode connection for a very large screen.

Figure 27:
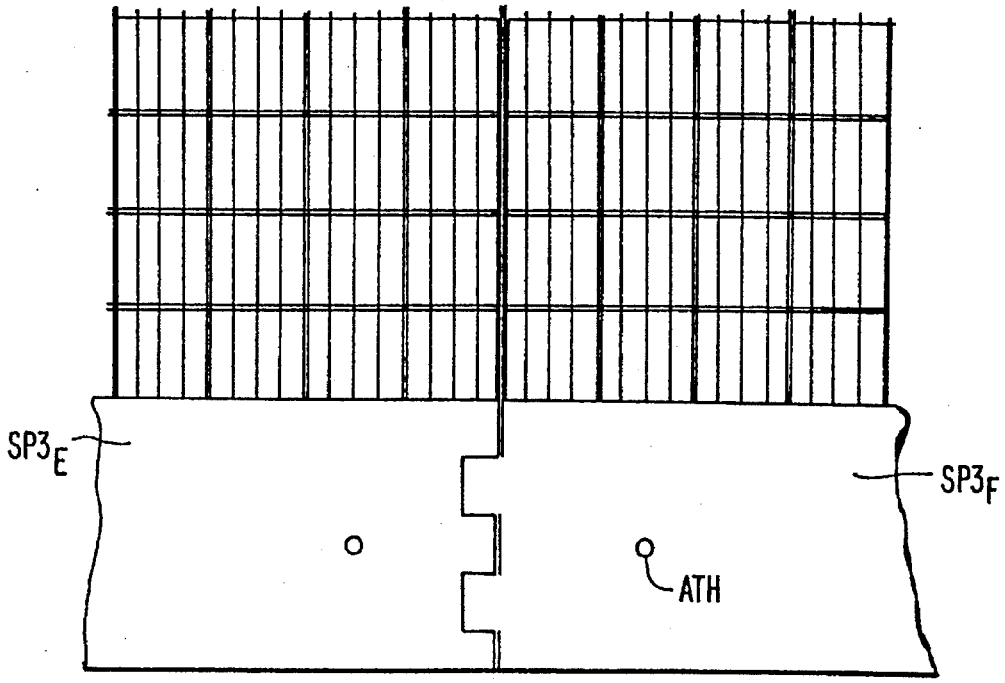
FIG. 27 is an example of the interface between two smaller spacer plates for constructing a larger spacer plate to provide single piece large display devices.
Figure 28:
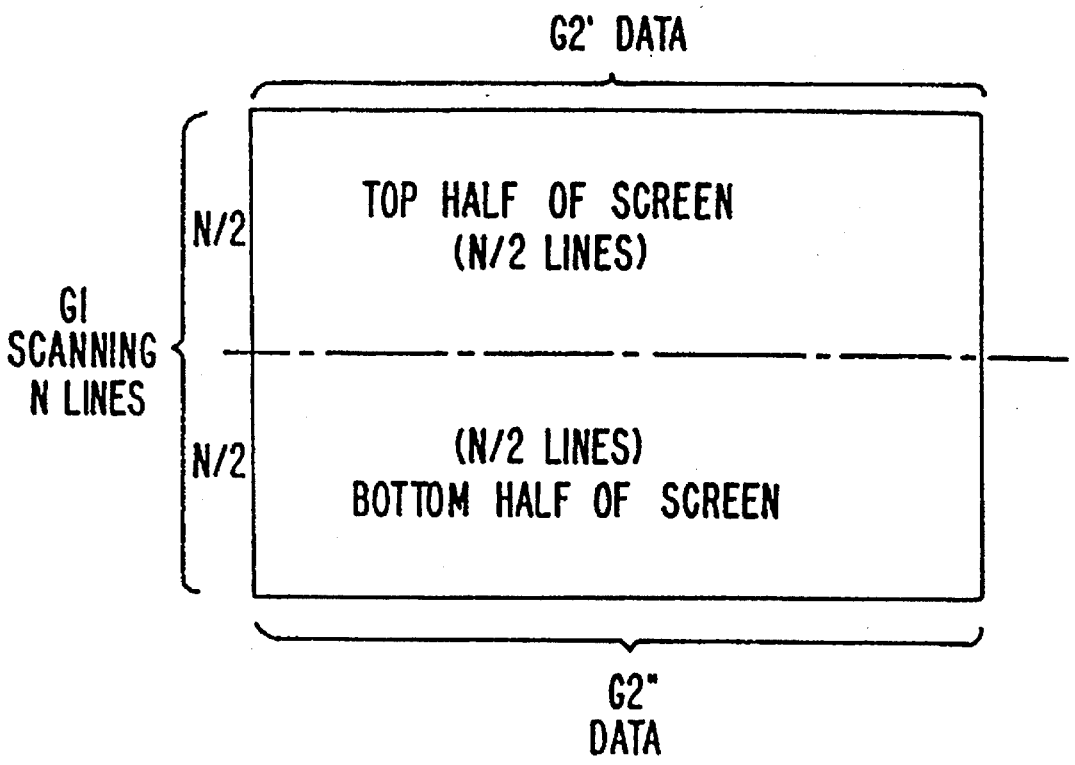
FIG. 28 is a schematic view of a display screen and grid electrodes for addressing the screen in a manner that scans two lines at a time to give a brighter display.

When spacer plates are made of multiple smaller plates, as is the case in this embodiment, two or more MAP can be employed in each corner to minimize the chance for these small plates to rotate. Alternatively, alignment through holes not inside the four corners may be used. When G2 electrodes are made of fine metal wires, because the control electrodes are sandwiched between every layers of spacer plates, alignment through holes ATH not located in one of the four corners can only align between two neighboring spacer plate layers. Addition alignment holes AH may be drilled or etched in the front face plate FFP to improve the precision of the alignment process. In this embodiment, each layer of spacer plate is made of eight smaller plates A through H as marked and as shown in dotted lines in FIG. 25B. In other words, SP3 is composed of eight smaller plates $SP3_A$ through $SP3_H$ (i.e., $SP3_{A-H}$). Each spacer plate is partitioned in a slightly different way or etched with matching protrusions p and grooves g at their ends in order to obtain maximum overall mechanical strength (FIG. 27). Alignment holes AH (FIG. 25C) are formed on the FFP. Alignment pins APESB are used to align SP3A-H with ESBs. Alignment pins APFFP are used to align SP2A-H and SP1A-H with the FFP. The loop of alignment is closed by aligning BFP, ESBs with the FFP through MAPs at the four corners of the screen. This alignment process allows all spacer plates to be precisely aligned. When G2 are made of electrodes plated on the surface of SP2, metal wires are not present at the top side and the bottom side of the screen assembly. This allows alignment pins AP to be placed through the alignment holes in FFP and alignment through holes ATH in SP3A-H, SP2A-H, SP1A-H and ESB for simple and precise alignments. These two alignment methods just discussed allow a very large display to be assembled from many pieces of smaller spacer plates. The result is the significantly increased maximum screen sizes for single piece EFD technology.

Along the edges of spacer plate layers SP1, SP2 and SP3, fine alignment notches AN are etched to align the fine metal wires used in control electrodes. This alignment notches AN will allow the control electrodes to stay aligned with the other components of the display during the sealing process. Without these alignment notches AN, the fine metal wires tend to drift away from their proper locations during the curing process of the sealing glass frit under the influence of various environmental factors in the high temperature sealing oven. These drifted wire locations produce many undesirable results, such as short circuits between neighboring electrodes, misalignments with phosphor dots and unstable control characteristics.

The high addressing resolution is achieved by the combination of (1) proper arrangement of cathode, G1, G2 and G3; (2) the short anode to control electrode distance; and (3) the uses of isolation walls in spacer plate SP2 and SP3. One advantage of the single piece implementation of EFD technology is that here we do not have to worry about the inter tile gaps. Due to this reason, the phosphor dot pitch in single piece EFD devices can be made much smaller as compared to EFD mosaic tiles. In single piece embodiment, the phosphor dot pitch is largely determined by the alignment errors between various part of the display device and the minimum thickness of the thin isolation walls. For a EFD device made with the Fotoform glass technology of Corning, phosphor dot pitch under 0.2 mm can be achieved.

Combining features described in this embodiment, screens with diagonal measurements of over 70 inches and phosphor dot pitch of under 0.2 mm can be produced. This technology provides some core ingredients necessary for the implementation of a full color, large area EFD device for the upcoming HDTV applications.

While the invention has been described above by reference to various embodiments, it will be understood that modifications and variations may be made without departing from the scope of the invention. For example, The scope of the invention is to be limited only by the appended claims.

What is claimed is:

1. A cathodoluminescent visual display device having a plurality of pixel dots for displaying images when said device is viewed in a viewing direction, comprising:

a housing defining a chamber therein, said housing having a face plate, a back plate, and a side wall between the face and back plates surrounding and enclosing said chamber;

an anode on or near said face plate;

luminescent means that emits light in response to electrons, and that is on or adjacent to the anode;

at least one cathode in the chamber between the face and back plates;

at least a first and a second set of elongated grid electrodes between the anode and cathode, the electrodes in each set overlapping the luminescent means and grid electrodes in at least one other set at points when viewed in the viewing direction, wherein the overlapping points define pixel dots;

means for causing the cathode to emit electrons;

means for applying electrical potentials to the anode, cathode and the two or more sets of grid electrodes, causing the electrons emitted by the cathode to travel to the luminescent means at the pixel dots on or adjacent to the anode for displaying images; and spacer means connecting the face and back plates to provide mechanical support for the plates so that the housing will not collapse when the chamber is evacuated, said spacer means including at least one spacer plate defining holes therein for passage of electrons between the anode and cathode, wherein a predetermined number of one or more pixel dots correspond to and spatially overlap one hole, thereby reducing crosstalk, said spacer plate attached to the side wall at locations surrounding the chamber to strengthen the housing against lateral forces.

2. The device of claim 1, wherein said anode and cathode are in two planes that are spaced apart, wherein the first and second sets of grid electrodes are in a first and a second plane respectively, said spacer means further comprising at least one net-shaped structure defining meshes that each permits electron passage to the luminescent means to address a plurality of pixel dots, said structure and said spacer plate rigidly connecting the face and back plates and the side wall.

3. The device of claim 1, wherein said face and back plates and the spacer plate have substantially the same planar dimensions, and wherein the three plates are attached directly or indirectly to the side wall at their edges to form a rigid structure.

4. The device of claim 2, said face and back plates being substantially parallel to each other, said spacer means further including elongated spacer members between the second plane and the back plate, said members connecting the structure to the back plate, wherein said structure, said spacer plate and spacer members include portions abutting each other and the face and back plates, said portions arranged along a line normal to the face and back plates forming a support for the face and back plates along said line, said device further comprising means for attaching said spacer plate, said spacer members to the face, back and side walls to form one rigid structure, wherein said structure comprises bars between meshes, said members being arranged so that they and some of the bars match and abut one another and lie along lines normal to the face and back plates.

5. The device of claim 2, wherein said structure comprises bars between meshes, and wherein each bar matches a space between two adjacent pixel dots.

6. The device of claim 2, wherein said structure comprises bars between meshes and adjacent to portions of the grid electrodes, wherein portions of at least some of the grid electrodes adjacent to the bars are spaced apart at closer spacings than those further away from the bars to reduce any dark shadows caused by the structure.

7. The device of claim 2, wherein said structure comprises bars between meshes and adjacent to portions of the grid electrodes, and wherein the potentials applying means applies potentials to at least some of the grid electrodes adjacent to the bars that are higher than those further away from the bars to reduce any dark shadows caused by the structure.

8. The device of claim 2, wherein said spacer means includes a plurality of said net-shaped structures, said structures being in the shape of plates placed substantially in a plane adjacent to one another to form a larger plate structure.

9. The device of claim 1, wherein said anode and cathode are in two planes that are spaced apart, wherein the first and second sets of grid electrodes are in a first and second plane respectively, said spacer plate being located between the anode and the closest of the first or second plane to the anode, said spacer plate defining holes therein having tapered surfaces, said spacer means further comprising at least one net-shaped structure, said structure including bars attached to one another to form the structure, said bars being tapered at substantially the same angle as the surfaces of the holes to form substantially smooth tapering surfaces.

10. The device of claim 1, wherein said anode and cathode are in two planes that are spaced apart, wherein the first and second sets of grid electrodes are in a first and second plane respectively, said spacer plate being located between the first and second planes, said spacer plate defining holes therein having tapered surfaces, said spacer means further comprising at least one net-shaped structure, said structure including bars attached to one another to form the structure, said bars being tapered at substantially the same angle as the surfaces of the holes to form substantially smooth tapering surfaces.

11. The device of claim 1, wherein the pixel dots are arranged in groups of adjacent dots displaying one or more colors, wherein each group of adjacent pixel dots for displaying the color or colors corresponds to and overlaps one hole in the viewing direction, said spacer plate further comprising means in said one hole for separating electrons addressing one of the group of pixel dots from electrons addressing a different one of the group of pixel dots to further reduce crosstalk.

12. The device of claim 11, wherein the pixel dots are arranged in groups of three or more adjacent dots displaying the colors red, green and blue, wherein each group of three or more adjacent pixel dots for displaying the colors red, green and blue correspond to and overlap one hole, said separating means comprising two or more separating walls separating the hole into three or more smaller holes, each corresponding to and overlapping each of the three or more red, green and blue pixel dots.

13. The device of claim 11, further comprising a conductive layer on said spacer plate or blocks to reduce the buildup of electrostatic charges.

14. The device of claim 1, further comprising adhesive means attaching said grid electrodes to said spacer means to reduce vibrations.

15. The device of claim 1, wherein said spacer plate is made of a photosensitive glass-ceramic material.

16. The device of claim 1, wherein dimensions of the holes at one side of the spacer plate are larger than those at the other side.

17. The device of claim 16, wherein the pixel dots are arranged in groups of adjacent dots, wherein each group corresponds to and overlaps one hole in the viewing direction, said spacer plate further comprising two or more separating walls separating at least one hole into smaller holes, each corresponding to and overlapping each of the pixel dots in a group of pixel dots corresponding to and overlapping said at least one hole, wherein each smaller hole tapers from one side of the spacer plate to the other, and wherein each smaller hole matches a pixel dot at the larger end of the hole.

18. The device of claim 16, wherein the holes at their larger dimensions match the pixel dots.

19. The device of claim 1, wherein said grid electrodes comprise wires, and wherein each hole is located so that it overlaps one wire, or two or more wires electrically connected, to form one or more electrodes for scanning the one or more pixel dots corresponding to the hole or controlling the brightness of such dots.

20. The device of claim 1, said spacer means further comprising adhesive means attaching the face, side wall and spacer plate or blocks to form a single rigid housing structure.

21. The device of claim 1, said spacer means including two or more spacer plates arranged in an array between the face and back plates, said spacer plates being net-shaped structures, wherein each of all of said spacer plates in the array, except for one or more of the spacer plates closest to the face plate, includes a side bar on one side of the net-shaped structure, said side bar attached to the side wall.

22. The device of claim 1, wherein said side wall is of such size that it extends from the face plate to the back plate or extends beyond the back plate.

23. The device of claim 22, further comprising wiring traces or other electrodes on inside surfaces of said side walls.

24. The device of claim 23, further comprising:

a printed circuit board attached to said back plate, said board having circuits thereon; and electrical connection means connecting said grid electrodes to circuits on the board outside the housing through the wiring traces or other electrodes on the side wall surfaces.

25. The device of claim 1, wherein said grid electrodes comprises perforated or etched foil and elongated finger connectors.

26. The device of claim 25, wherein said side wall is of such size that it extends from the face plate to the back plate or extends beyond the back plate, and wherein said elongated finger connectors also extend beyond the back plate for connection to circuits outside the chamber.

27. The device of claim 1, wherein said grid electrodes are made of metal wire cloth meshes, wherein the orientation of the meshes is at an angle other than 0 or 90 degrees to the side walls, to minimize effect of thermal expansion differences.

28. The device of claim 1, said housing comprising both a side plate and a side wall, said side plate being a reinforcement bar in the chamber and attached to a surface of said side wall, wherein the reinforcement bar abuts and is attached to the back plate and the spacer plate.

29. The device of claim 1, wherein said side wall is at an acute angle to a plane normal to the face plate to reduce inter tile gap of front face plate and to minimize impact of dust or other foreign particles when the device is adjacent to other similar devices in a mosaic display.

30. The device of claim 1, further comprising a protective or buffering material wrapping, coating attached to the side wall at surfaces outside the chamber.

31. The device of claim 1, said device further comprising a metal core glass tube electrically connecting said anode to circuits outside the housing.

32. The device of claim 1, said device having an outgassing hole, said device further comprising a metal core glass tube through an isolation bench on top of, overlapping, but not covering up, the outgassing hole.

33. The apparatus of claim 1, wherein said side wall includes a unitary plate between and abutting the face and back plates.

34. The apparatus of claim 33, wherein the thickness of the side wall is in a range of about 0.2 mm to 2 mm.

35. The apparatus of claim 29, wherein said acute angle is less than about 10 degrees.

36. A cathodoluminescent visual display apparatus comprising a mosaic of devices arranged side by side to form a larger display, each device having a plurality of pixel dots for displaying images when viewed in a viewing direction and comprising:

a housing defining a chamber therein, said housing having a face plate, and a back plate;

an anode on or near said face plate;

luminescent means that emits light in response to electrons, and that is on or adjacent to the anode;

at least one cathode in the chamber between the face and back plates;

at least a first and a second set of elongated grid electrodes between the anode and cathode, the electrodes in each set overlapping the luminescent means and electrodes in at least one other set at points when viewed in the viewing direction, wherein the overlapping points define pixel dots;

means for causing the cathode to emit electrons;

means for applying electrical potentials to the anode, cathode and the two or more sets of grid electrodes, causing the electrons emitted by the cathode to travel to the luminescent means at the pixel dots on or adjacent to the anode for displaying images; and spacer means connecting the face and back plates to provide mechanical support for the plates so that the housing will not collapse when the chamber is evacuated, said spacer means including a spacer plate defining holes therein for passage of electrons between the anode and cathode, wherein a predetermined number of one or more pixel dots correspond to and spatially overlap one hole, thereby reducing crosstalk.

37. The apparatus of claim 36, said housing further comprising a side wall between the face and back plates surrounding and enclosing said chamber, said spacer plate attached to the side wall at locations surrounding the chamber to strengthen the housing against lateral forces.

38. A cathodoluminescent visual display device which comprises:

a housing defining a chamber therein, said housing having a front face plate, a back face plate, and a side wall between the front and back plates surrounding and enclosing said chamber, said face plates and said side wall having inside surfaces facing the chamber;

at least one cathode;

an anode on or adjacent to the inside surface of the front face plate;

one or more layers of spacer plates or spacer bar arrays or layers of both placed between the front face and back face plates, said spacer plates and/or spacer bar arrays abutting one another and the front and back face plates to form a support for the front and back face plates when the chamber is evacuated, wherein said spacer plate layers, or spacer bar arrays, the front face plate and the back face plate define alignment holes therein;

alignment pins placed in said holes to fix the relative positions between said plates and/or arrays;

a multitude of cathodoluminescent phosphor dots on top of the anode;

at least a first and a second set of grid electrodes between the anode and cathodes and separated from the anode, cathode and each other by said layers of spacer plates or spacer bar arrays;

means for causing the cathode to generate an electron cloud; and means for applying electrical potentials to the sets of grid electrodes, the anode and cathode, to cause the electrons in the cloud to travel from the cathode to the phosphor dots for displaying images.

39. The device of claim 38, said housing including a side wall, said device further comprising reinforcement bars attached to the inside surface of the side wall, said reinforcement bars abutting the back face plate and spacer plate or spacer bar array layers, wherein said side wall reinforcement bars have multiple alignment slots on one side, and wherein said spacer bar array layers have edges that fit into said slots, for aligning said layers relative to the side wall.

40. The device of claim 38, said housing including a side plate, said side plate abutting the back face plate and spacer plate or spacer bar array layers, wherein said side plate has multiple alignment slots on one side, and wherein said spacer bar array layers have edges that fit into said slots, for aligning said layers relative to the side plate.

41. The device of claim 38, wherein said spacer plate layers each comprises a plurality of spacer plates arranged adjacent to one another in substantially the same plane, each of such spacer plates having alignment through holes, protrusions and grooves that fit matching grooves and protrusions of adjacent spacer plates to enable high precision alignment of such spacer plates to form one of said spacer plate layers, and to enable such layers to withstand lateral forces on the device.

42. The device of claim 38, wherein the spacer bars have surfaces and are each made of a unitary piece of glass for increased mechanical strength, said spacer bars have through holes therein for alignment, and alignment slots to align the position of spacer bars with the side walls.

43. The device of claim 38, said device having layers of both spacer plates and spacer bar arrays, wherein said spacer bar array and the spacer plate layers all have tapered wall surfaces which, when stacked together and aligned using said alignment pins, will form a forest of wedge shaped walls between front face plate and back face plate, said wedge shaped walls being thicker at locations adjacent the back face plate than at locations adjacent the front face plate, and said forest of wedge shaped walls become being of a higher density at locations adjacent the front face plate than at locations adjacent the back face plate.

44. The device of claim 38, wherein said spacer plates have edges and define alignment notches along their edges for holding and aligning the grid electrodes.

45. The device of claim 38, wherein said alignment pins comprise glass tubes with electrically conductive cores, said cores connected to the anode to provide electrical connections to the anode.

46. The device of claim 38, further comprising adhesive means for attaching the front face plate, spacer plates, spacer bars and back face plate together along contacting surfaces to form one compound solid structure to provide high mechanical strength for large size display screens.

47. A cathodoluminescent visual display device which comprises:

a housing defining a chamber therein, said housing having a front face plate, a back face plate, and a side wall between the face and back plates surrounding and enclosing said chamber;

at least one cathode;

an anode on or adjacent to the inside surface of front face plate;

one or more layers of spacer plates or spacer bar arrays placed between the front face and back face plates, said spacer plates and/or spacer bar arrays abutting one another and the front and back face plates to form a support for the front and back face plates when the chamber is evacuated, said spacer plate defining holes therein for passage of electrons between the anode and cathode, wherein a predetermined number of pixel dots correspond to and spatially overlap one hole when the device is viewed in a viewing direction, thereby reducing crosstalk;

a multitude of cathodoluminescent phosphor dots on top of the anode;

at least a first and a second set of grid electrodes between the anode and cathodes and separated from the anode, cathode and each other by said layers of spacer plates or spacer bar arrays, wherein said grid electrodes comprise groups of parallel fine metal wires, metal wire cloth meshes, perforated or etched metal foils, or plated electrodes on the surfaces of the spacer plates or spacer bar arrays;

means for causing the cathode to generate an electron cloud; and means for applying electrical potentials to the sets of grid electrodes, the anode and cathode, to cause the electrons in the cloud to travel from the cathode to the phosphor dots for displaying images.

48. The device of claim 47, wherein a first set of grid electrodes is for controlling the brightness of the display defining the data electrodes and a second set, defining the scanning electrodes that are transverse to the data electrodes, is for scanning lines of pixel dots across the anode and wherein the data electrodes comprise two arrays arranged with the data electrodes aligned substantially along a direction, so that each line of pixel dots along the direction of the data electrodes overlap two independently addressable data electrodes, so that two lines of pixel dots in two different areas of the image can be scanned simultaneously.

49. A cathodoluminescent visual display device which comprises:

a housing defining a chamber therein, said housing having a face plate, a back plate, and a side wall between the face and back plates surrounding and enclosing said chamber;

at least one cathode;

an anode on or adjacent to the inside surface of front face plate;

one or more layers of spacer plates or spacer bar arrays placed between the front face and back face plates;

a multitude of cathodoluminescent phosphor dots on top of the anode;

at least a first and a second set of grid electrodes between the anode and cathodes and separated from the anode, cathode and each other by said layers of spacer plates or spacer bar arrays;

means for causing the cathode to generate an electron cloud; and means for applying electrical potentials to the sets of grid electrodes, the anode and cathode, to cause the electrons in the cloud to travel from the cathode to the phosphor dots for displaying images;

wherein one or more of the said side walls, the spacer bars, spacer plates and the back face plate have electrodes printed on their surfaces in or facing the chamber, said electrodes containing material that emits secondary electrons upon being impinged by electrons, thereby spreading out the electrons generated by the cathode to improve the uniformity of the device and countering the electric field caused by static charge build up.

50. A cathodoluminescent visual display device which comprises:

a housing defining a chamber therein, said housing having a face plate, a back plate, and a side wall between the face and back plates surrounding and enclosing said chamber;

at least one cathode;

an anode on or adjacent to the inside surface of front face plate;

one or more layers of spacer plates or spacer bar arrays placed between the front face and back face plates, said spacer plates and/or spacer bar arrays abutting one another and the front and back face plates to form a support for the front and back face plates when the chamber is evacuated;

a multitude of cathodoluminescent phosphor dots on top of the anode, areas of the dots that emit light upon impingement of electrons defining the active areas of the dots, wherein the active areas of at least some dots are different from those of other dots;

at least a first and a second set of grid electrodes between the anode and cathodes and separated from the anode, cathode and each other by said layers of spacer plates or spacer bar arrays;

means for causing the cathode to generate an electron cloud; and means for applying electrical potentials to the sets of grid electrodes, the anode and cathode, to cause the electrons in the cloud to travel from the cathode to the phosphor dots for displaying images.

51. The device of claim 50, wherein at least some phosphor dots are larger and contain larger active areas than other phosphor dots.

52. The device of claim 50, wherein, for a group of phosphor dots, the dots are of the same size but some dots contain smaller areas that do not emit light upon impingement of electrons than others in the group.

53. A cathodoluminescent visual display device which comprises:

a housing defining a chamber therein, said housing having a face plate, a back plate, and a side wall between the face and back plates surrounding and enclosing said chamber;

at least one cathode;

an anode on or adjacent to the inside surface of front face plate;

one or more layers of spacer plates or spacer bar arrays placed between the front face and back face plates, said spacer plates and/or spacer bar arrays abutting one another and the front and back face plates to form a support for the front and back face plates when the chamber is evacuated, said spacer plate defining holes therein for passage of electrons between the anode and cathode, wherein a predetermined number of one or more pixel dots correspond to and spatially overlap one hole, thereby reducing crosstalk, a multitude of cathodoluminescent phosphor dots on top of the anode;

at least a first and a second set of grid electrodes between the anode and cathodes and separated from the anode, cathode and each other by said layers of spacer plates or spacer bar arrays;

means for causing the cathode to generate an electron cloud; and means for applying electrical potentials to the sets of grid electrodes, the anode and cathode, to cause the electrons in the cloud to travel from the cathode to the phosphor dots for displaying images;

wherein said phosphor dots are arranged in linear arrays of the same color selected from the group: red, green and blue.

54. The device of claim 53, wherein said arrays are vertical columns, said columns forming an alternating pattern of the following sequence: a red column, a green column and a blue column.

55. The device of claim 53, wherein said arrays are vertical columns, said columns forming an alternating pattern of the following sequence: a red column, a green column, a blue column and another green column.

56. The device of claim 53, wherein said arrays are diagonally oriented when viewed in the viewing direction, said arrays forming an alternating pattern of the following sequence: a red array, a green array, a blue array and another green array.

57. A cathodoluminescent visual display device which comprises:

a housing defining a chamber therein, said housing having a face plate, a back plate, and a side wall between the face and back plates surrounding and enclosing said chamber;

at least one cathode;

an anode on or adjacent to the inside surface of front face plate;

one or more layers of spacer plates or spacer bar arrays placed between the front face and back face plates;

a multitude of cathodoluminescent phosphor dots on top of the anode; wherein said front face plate is made of, or includes a layer of, spectrum selective glass with transmittance peaks that match the emission peaks of the said cathodoluminescent phosphor dots;

at least a first and a second set of grid electrodes between the anode and cathodes and separated from the anode, cathode and each other by said layers of spacer plates or spacer bar arrays;

means for causing the cathode to generate an electron cloud; and means for applying electrical potentials to the sets of grid electrodes, the anode and cathode, to cause the electrons in the cloud to travel from the cathode to the phosphor dots for displaying images.

58. The device of claim 57, said phosphors including three types of phosphor dots that emit red, green and blue light, wherein said front face plate is made of spectrum selective glass with three transmittance peaks that match the emission peaks of the said red, green and blue cathodoluminescent phosphors.

59. The device of claim 57, wherein said phosphor dots include different types that emit light of different colors, wherein said front face plate comprises a transparent plate and, on the transparent plate, a filter coating in the shape of a two dimensional array of different types of filter dots, the different types of dots for filtering light of different colors, each type of filter dots being located on the transparent plate so that they overlap the corresponding phosphor dot of the same color when viewed in a viewing direction of the device, wherein, each filter dot's transmittance peak matches the emission peaks of the corresponding phosphor dot.

60. The device of claim 59, said front face plate having an outside surface not in the chamber, wherein said filter dot array is coated on the outside surface of the front face plate, said array being located so that there are gaps G between the filter dots of different color.

61. A cathodoluminescent visual display device which comprises:

a housing defining a chamber therein, said housing having a face plate, a back plate, and a side wall between the face and back plates surrounding and enclosing said chamber;

wherein said front face plate comprises a Fresnel optical lens;

at least one cathode;

an anode on or adjacent to the inside surface of front face plate;

one or more layers of spacer plates or spacer bar arrays placed between the front face and back face plates;

a multitude of cathodoluminescent phosphor dots on top of the anode;

at least a first and a second set of grid electrodes between the anode and cathodes and separated from the anode, cathode and each other by said layers of spacer plates or spacer bar arrays;

means for causing the cathode to generate an electron cloud; and means for applying electrical potentials to the sets of grid electrodes, the anode and cathode, to cause the electrons in the cloud to travel from the cathode to the phosphor dots for displaying images.

* * * * *

UNITED STATES PATENT AND TRADEMARK OFFICE

CERTIFICATE OF CORRECTION

PATENT NO. : 5,565,742

DATED : October 15, 1996

INVENTOR(S) : Shichao et al.

It is certified that error appears in the above-indentified patent and that said Letters Patent is hereby corrected as shown below:

On the Title Page, Section [56], References Cited, U.S. Patent Documents, please include the following U.S. Patent Documents:

| | | | |
|---|---|---|---|
| --[56] | 5,424,605 | 6/1995 | Lovoi |
| | 5,126,628 | 6/1992 | Kishimoto et al. |
| | 5,413,513 | 5/1995 | Horne et al. |
| | 5,205,770 | 4/1993 | Lowrey et al. |
| | 4,183,125 | 1/1980 | Meyer et al. |
| | 4,340,838 | 7/1982 | Kobale et al. |
| | 5,436,530 | 7/1995 | Susuke et al.-- |

Signed and Sealed this

Sixteenth Day of December, 1997

Bruce Lehman

*Attest:*

BRUCE LEHMAN

*Attesting Officer*

*Commissioner of Patents and Trademarks*